US006200181B1

(12) United States Patent
Narayanan et al.

(10) Patent No.: US 6,200,181 B1
(45) Date of Patent: Mar. 13, 2001

(54) THERMALLY CONDUCTIVE SPACER MATERIALS AND SPACER ATTACHMENT METHODS FOR THIN CATHODE RAY TUBE

(75) Inventors: Kollengode S. Narayanan, Cupertino; George B. Hopple, Palo Alto; Theodore S. Fahlen; John P. Klatt, both of San Jose, all of CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

(21) Appl. No.: 09/127,285

(22) Filed: Jul. 31, 1998

Related U.S. Application Data

(63) Continuation-in-part of application No. 08/886,227, filed on Jul. 1, 1997, now Pat. No. 6,111,351.

(51) Int. Cl.[7] ..... H01J 9/24
(52) U.S. Cl. ..... 445/24
(58) Field of Search ..... 313/309, 495; 445/24

(56) References Cited

U.S. PATENT DOCUMENTS

| | | | | |
|---|---|---|---|---|
| 4,835,039 | | 5/1989 | Barringer et al. | 428/210 |
| 4,883,778 | * | 11/1989 | Singhdeo et al. | 501/19 |
| 5,206,484 | * | 4/1993 | Issartel | 219/270 |
| 5,543,683 | | 8/1996 | Haven et al. | 313/461 |
| 5,589,731 | | 12/1996 | Fahlen et al. | 313/495 |
| 5,614,781 | | 3/1997 | Spindt et al. | 313/422 |
| 5,674,634 | | 10/1997 | Wang et al. | 428/688 |

FOREIGN PATENT DOCUMENTS

| | | | |
|---|---|---|---|
| 0 405 262 A1 | 1/1991 | (EP) | H01J/31/12 |

* cited by examiner

*Primary Examiner*—Kenneth J. Ramsey
(74) *Attorney, Agent, or Firm*—Wagner, Murabito & Hao LLP

(57) ABSTRACT

Walls for a flat panel display and a method for forming walls for a flat panel display that have improved thermal conductivity and decreased thermal coefficient of resistivity. In one embodiment, walls are fabricated using alumina, molybdenum, and titania. These oxide materials (alumina and titania) are mixed with the a metal oxide and cast so as to form thin sheets of material that are then heated. The heating process reduces the metal oxides to their metallic state. The resulting thin sheets of material are then cut to form walls. This produces walls having a higher thermal conductivity than prior art walls. In addition, the thermal coefficient of resistivity of the resulting material is significantly lower than that of prior art materials used for making walls. A flat panel display having the walls of the present invention does not exhibit non-illuminated regions of the visible display due to wall-related thermal effects.

13 Claims, 23 Drawing Sheets

THERMALLY CONDUCTIVE SPACER MATERIALS AND SPACER ATTACHMENT METHODS FOR THIN CATHODE RAY TUBE

CROSS-REFERENCE TO RELATED APPLICATION

This patent application is a Continuation-In-Part of commonly-owned U.S. patent application Ser. No. 08/886,227, filed on Jul. 1, 1997, entitled "WALL ASSEMBLY AND METHOD FOR ATTACHING WALLS FOR FLAT PANEL DISPLAY," by Narayanan et al, now U.S. Pat. No. 6,111,351.

TECHNICAL FIELD

The present claimed invention relates to the field of flat panel displays. More specifically, the present claimed invention relates to a flat panel display having walls that have superior heat conductivity and thermal coefficient of resistivity.

BACKGROUND ART

A Cathode Ray Tube (CRT) display generally provides the best brightness, highest contrast, best color quality and largest viewing angle of prior art computer displays. CRT displays typically use a layer of phosphor which is deposited on a thin glass faceplate. These CRTs generate a picture by using one to three electron beams which generate high energy electrons that are scanned across the phosphor in a raster pattern. The phosphor converts the electron energy into visible light so as to form the desired picture. However, prior art CRT displays are large and bulky due to the large vacuum envelopes that enclose the cathode and extend from the cathode to the faceplate of the display. Therefore, typically, other types of display technologies such as active matrix liquid crystal display, plasma display and electroluminescent display technologies have been used in the past to form thin displays.

Recently, a thin flat panel display has been developed which uses a backplate including a matrix structure of rows and columns of electrodes to generate a visible display. Typically, the backplate is formed by depositing a cathode structure (electron emitting) on a glass plate. The cathode structure includes emitters that generate electrons. The backplate typically has an active area surface within which the cathode structure is deposited. Typically, the active area surface does not cover the entire surface of the glass plate, a thin strip is left around the edges of the glass plate. The thin strip is referred to as a border or a border region. Conductive traces extend through the border to allow for electrical connectivity to the active area surface. These traces are typically covered by a dielectric film as they extend across the border so as to prevent shorting.

Prior art thin flat panel displays include a thin glass faceplate (anode) that is separated from the backplate by about 1 millimeter. Walls or "spacers" are currently used in prior art thin flat panel display assembly to separate the faceplate and the backplate. The faceplate includes an active area surface within which the layer of phosphor is deposited. The faceplate also includes a border region. The border is a thin strip that extends from the active area surface to the edges of the glass plate. The faceplate is attached to the backplate using a glass sealing structure. This sealing structure is typically formed by melting a glass frit in a high temperature heating step. This forms an enclosure that is pumped out so as to produce a vacuum between the active area surface of the backplate and the active area surface of the faceplate. Individual regions of the cathode are selectively activated to generate electrons which strike the phosphor so as to generate a visible display within the active area surface of the faceplate. These FED flat panel displays have all of the advantages of conventional CRTs but are much thinner.

The faceplate of a thin flat panel display requires a conductive anode electrode to carry the current used to illuminate the display. Conventional walls are resistive in order to bleed off charge which may otherwise result in deleterious electron deflection. The walls should not interfere with the travel path of electrons as the electrons pass from the backplate to the faceplate. Typically, prior art walls are made of ceramic. However, though ceramic material can be made to have the required resistivity, ceramic material also has relatively low thermal conductivity and high coefficient of thermal resistivity.

In order to generate a bright image on a region of a thin flat panel display, a high level of electron emission is required. As a bright image is generated on a region of a thin flat panel display, electrons lose energy as they penetrate the faceplate at the brightly illuminated region, thereby heating up the faceplate. This results in regions of the faceplate that are heated.

Because of the relatively low thermal conductivity of prior art walls and the glass faceplate and the vacuum environment, the local faceplate heating generated at bright regions of the visible display is not dissipated readily. The walls are one of the heat dissipative components, but because prior art walls are poor thermal conductors, they tend to heat up locally. A temperature gradient is then generated across the wall. Since the thermal coefficient of resistivity of prior art walls is high, the local heating of the walls decreases(or increases) the resistivity of the walls locally. This local decrease(or increase) in resistivity results in a voltage gradient along the wall from anode to cathode that is non-linear compared to that of free space next to the wall.

The local nonlinear voltage gradient along the walls causes the deflection of electron beams either towards or away from the wall. This produces regions within the visible display that are not illuminated. More particularly, the deflection and attraction of the wall surfaces causes visible non-illuminated regions in the form of non-illuminated lines that extend across the visible display. Also, the non-linear voltage gradient along the wall can result in arcing between the cathode and the wall.

Thus, a need exists for a flat panel display that does not produce non-illuminated regions of the visible display as a result of local heating effects. More particularly, a need exists for a flat panel display that does not produce visible non-illuminated regions of the visible display as a result of heating of walls. More particularly, a need exists for walls that can conduct heat away from the faceplate and that do not produce voltage variations as a result of local heating. The present invention meets the above needs.

DISCLOSURE OF THE INVENTION

The present invention provides a thin flat panel display that includes walls that have a high thermal conductivity and a low thermal coefficient of resistivity. This produces a flat panel display that does not produce non-illuminated regions of the visible display as regions of the visible display are brightly illuminated.

In one embodiment of the present invention a backplate is formed by forming a cathode on an active area surface of a glass plate. The faceplate is formed by depositing luminescent material within an active area surface formed on a glass plate. Walls are attached to the faceplate using supporting structures which mechanically hold each wall to the faceplate. A glass sealing material is placed within the border of the faceplate. The backplate is then placed over the faceplate such that the walls and the glass frit are disposed between the faceplate and the backplate. The assembly is then sealed by thermal processing and evacuation steps so as to form a complete flat panel display.

The walls of the present invention have a high thermal conductivity and a low thermal coefficient of resistivity. In one embodiment, a ceramic material that includes dispersed metal is used to obtain the desired properties.

In one embodiment, spacer walls are fabricated using materials that include ceramic and a metal oxide. First, metal oxide particles are mixed with a ceramic powder and binders so as to form a slurry. The slurry is then tape cast into thin sheets. A heating step is then performed on the thin sheets so as to burn-out the binder and sinter the sheets. This reduces the metallic oxide into metallic particles uniformly dispersed in a ceramic matrix. The resulting thin sheets are then diced so as to form spacers.

In one embodiment, a layer of metal is selectively applied to the spacers so as to form conductive strips that allow for bleed-off of electrical charge. Additionally, in one embodiment, the walls are coated with a material that reduces secondary electron emission.

The spacer walls of the present invention have a higher thermal conductivity than prior art walls. Thus, heat is dissipated readily through the walls. Therefore, in the present invention, heat from bright regions of the visible display is conducted away from the faceplate and to the backplate where the heat is dissipated. Also, because the thermal coefficient of resistivity of the walls of the present invention is lower than that of prior art walls, resistivity is more uniform. This eliminates the prior art problems of local decreases in resistivity with concomitant non-linear voltage gradient and electron deflection.

Because of the dissipation of heat and the uniform resistivity of the walls of the present invention, local non-linear voltage gradient along the walls due to thermal effects is eliminated. This gives a visible display that does not include visible non-illuminated regions in the form of non-illuminated lines that extend across the visible display. Thereby improving the "invisibility" of spacers in an operating display. Also, since the display of the present invention does not generate locally charged regions as a result of thermal effects, arcing resulting from thermal effects is eliminated.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail as not to unnecessarily obscure aspects of the present invention.

Figure 1:
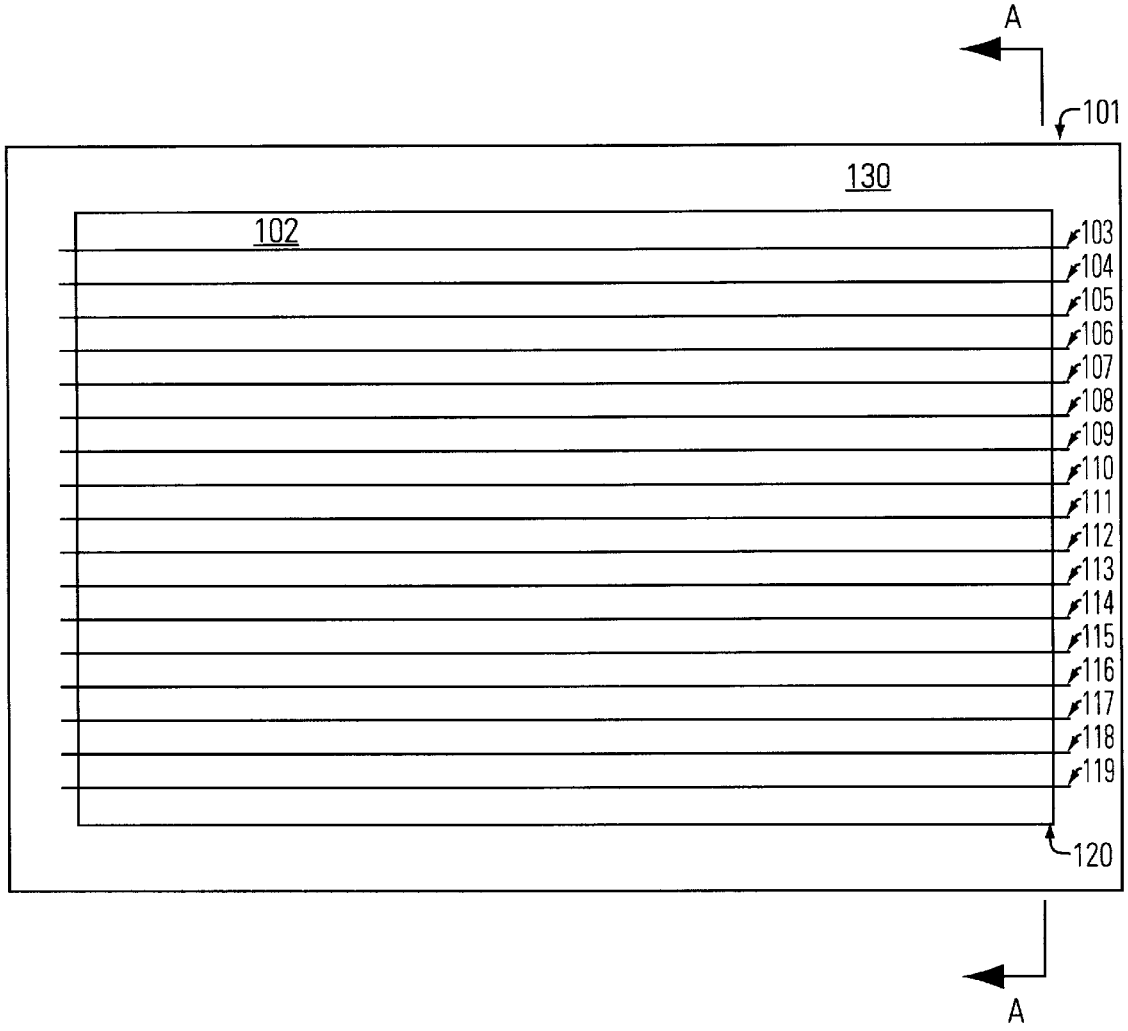
FIG. 1 is a top view illustrating a faceplate over which walls are located in accordance with the present claimed invention.

In one embodiment of the present invention, shown in FIG. 1, faceplate 101 is a glass plate onto which successive layers of material have been deposited so as to form screen structure 102, commonly referred to as a black matrix structure. An active area surface formed within screen structure 102 includes one or more areas of phosphor. These phosphor areas emit light when activated by electrons so as to form a visible display. Walls 103–120 are attached to faceplate 101 such that they extend vertically along a plane perpendicular to top surface 130 of faceplate 101.

Figure 2:
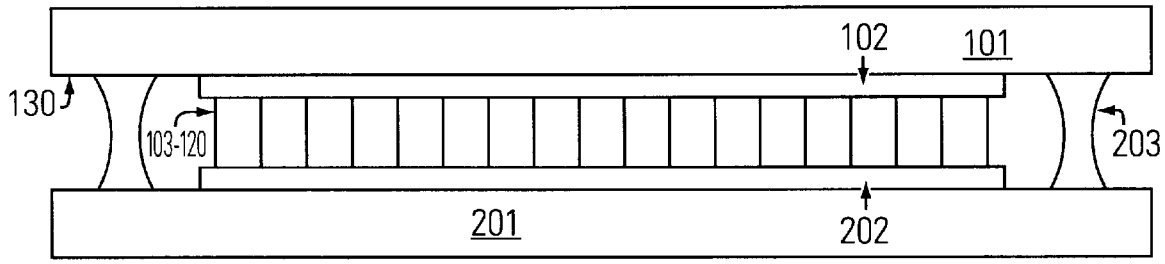
FIG. 2 is a side cross sectional view along axis A—A of FIG. 1 illustrating a flat panel display in accordance with the present claimed invention.

With reference to FIG. 2, walls 103–120 extend vertically between backplate 201 and faceplate 101 so as to give uniform spacing between faceplate 101 and backplate 201. In one embodiment of the present invention, backplate 201 of FIG. 2 is formed with an active area surface which includes a cathodic structure 202 having emitters which emit electrons. Cathodic structure 202 does not cover the entire surface area of backplate 201 so as to allow enough space around the periphery of backplate 201 for sealing backplate 201. Glass seal 203 extends around the periphery of backplate 201 and faceplate 101 within the border region so as to form an enclosure that contains cathodic structure 202, screen structure 102, and walls 103–120. In one embodiment of the present invention, seal 203 is formed by melting glass frit. The active area surface formed on faceplate 101 is disposed across from the active area surface of backplate 201 so as to form an active area therebetween.

Figure 3:
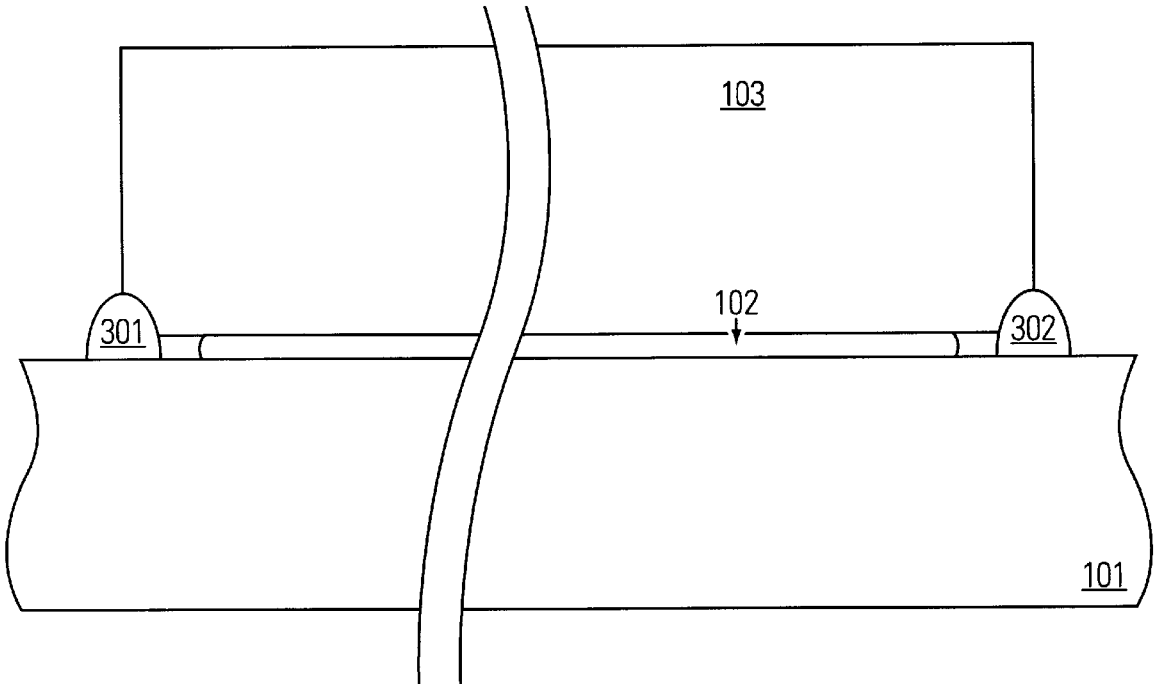
FIG. 3 is a side view illustrating a wall which is attached to a faceplate in accordance with the present claimed invention.

FIG. 3 shows an embodiment in which wall 103 is held in place by adhesive drop 301 located on one end of wall 103 and adhesive drop 302 located on the opposite end of wall 103. In one embodiment of the present invention, a UV curable polyimide adhesive such as Probimide 7020 manufactured by Olin Corporation is used to form adhesive drops 301–302. Alternatively, a thermally cured adhesive such as Epo-Tek P1011 or an inorganic adhesive may be used. Adhesive deposits 301–302 are placed outside of structure 102 such that they do not interfere with the operation of the flat panel display. In one embodiment, a fraction of a cubic centimeter of Probimide is deposited using an automated dispenser. Wall 103 is inserted such that it cuts the Probimide so as to form an equal Probimide meniscus on each side of wall 103. The resulting Probimide deposits are then cured by applying UV light for 60 to 90 seconds. In one embodiment, UV light having a wavelength of 365 nanometers is applied using fiber optic delivery to cure adhesive deposits 301–302. Alternatively, a stream of air heated to approximately 150 degrees centigrade is applied to adhesive deposits 301–302 for three minutes. It is important to form an equal adhesive meniscus on each side of wall 103 so that, when the adhesive cures, there is no movement and no resulting misalignment of wall 103.

Alternatively, a single adhesive drop could be used, placing the drop on one end or the other of each wall instead of on both ends. This would prevent any distortion and bending of the wall due to mismatch between the coefficient of thermal expansion of the materials of the glass substrate and the walls in a high temperature environment. However, the adhesive tends to shrink after curing and acts as a spring, pulling the wall so as to make the wall tilt along the longitudinal axis of the wall. Therefore it is important to make sure the wall is securely held in place, such as by a mechanical fixture, until the adhesive cures.

The chemical properties of the UV curable polymer adhesive allow for room temperature UV curing and the imidization that occurs during subsequent thermal process steps provides structural integrity. The UV curable polymer has low outgassing rate (less than $10^{-11}$ liter torr/sec).

Figure 4:
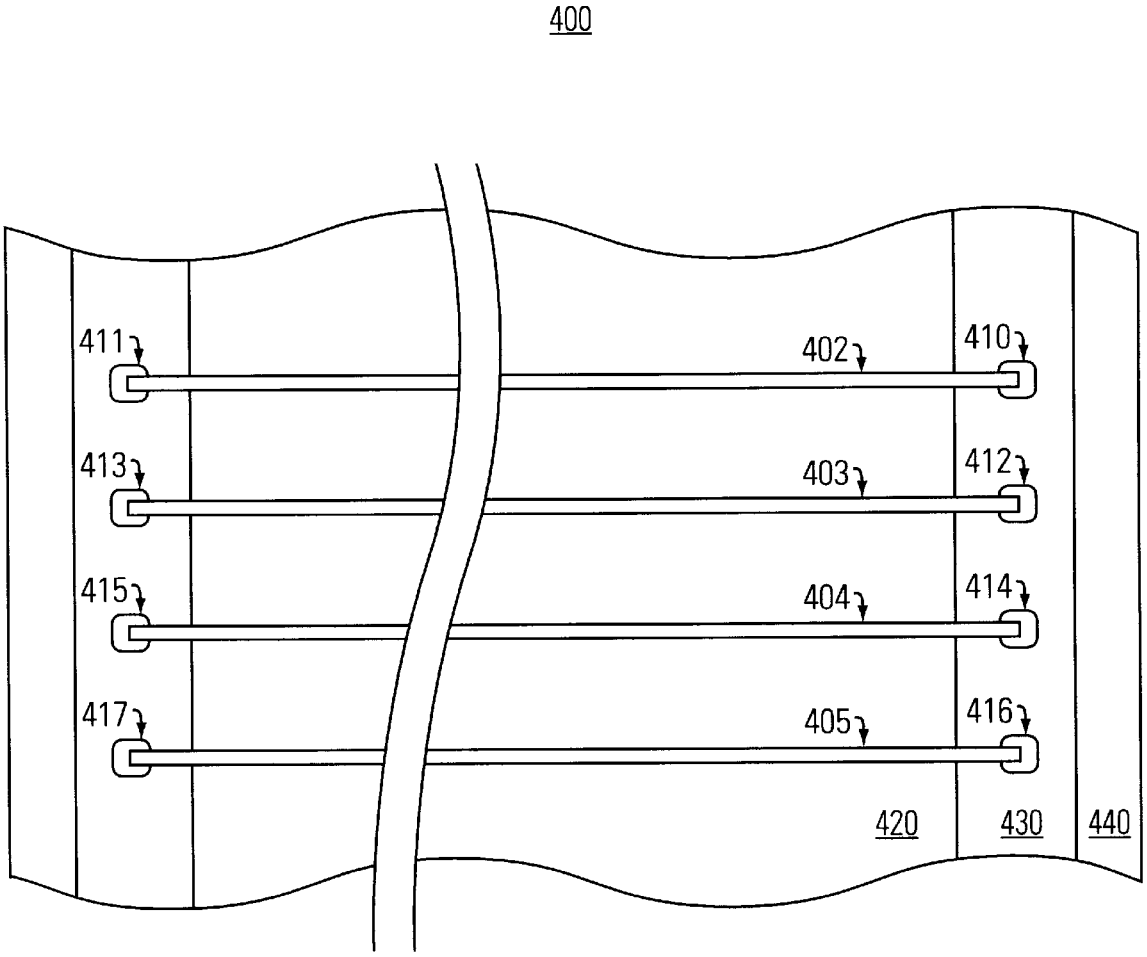
FIG. 4 is a top view illustrating walls attached to a faceplate in accordance with the present claimed invention.

In an alternate embodiment of the present invention shown in FIG. 4, preformed adhesive blocks 410–417 are used to attach walls 402–405 to faceplate 400. Faceplate 400 includes glass plate 440 over which screen structure 430 is formed. In one embodiment screen structure 430 is formed by depositing polyimide over glass plate 440 and forming active area surface 420 therewithin by depositing phosphors within openings in screen structure 430 such that phosphors overlie glass plate 440. Wall 402 is supported on one end by adhesive block 410 and on the other end by adhesive block 411. Similarly, wall 403 is supported on one end by adhesive block 412 and on the other end by adhesive block 413. Adhesive blocks 410–417 are u-shaped such that walls 402–405 nest within the center of adhesive blocks 410–417. In one embodiment, preformed adhesive blocks 410–417 are u-shaped and they are formed of bismaleimide. The bismaleimide adhesive blocks are cured by applying heat. Since bismaleimide does not cause arcing when placed near an active area surface, the length of walls 402–405 needs only be long enough to extend through active area surface 420. Blocks 410–417 are placed within the border area so that the adhesive does not interfere with the operation of the active area surface 420 of the display. Thus, though a border area is required for the attachment of blocks 410–417, the width of the border region surrounding active area surface 420 is smaller than that of prior art displays.

Figure 5A:
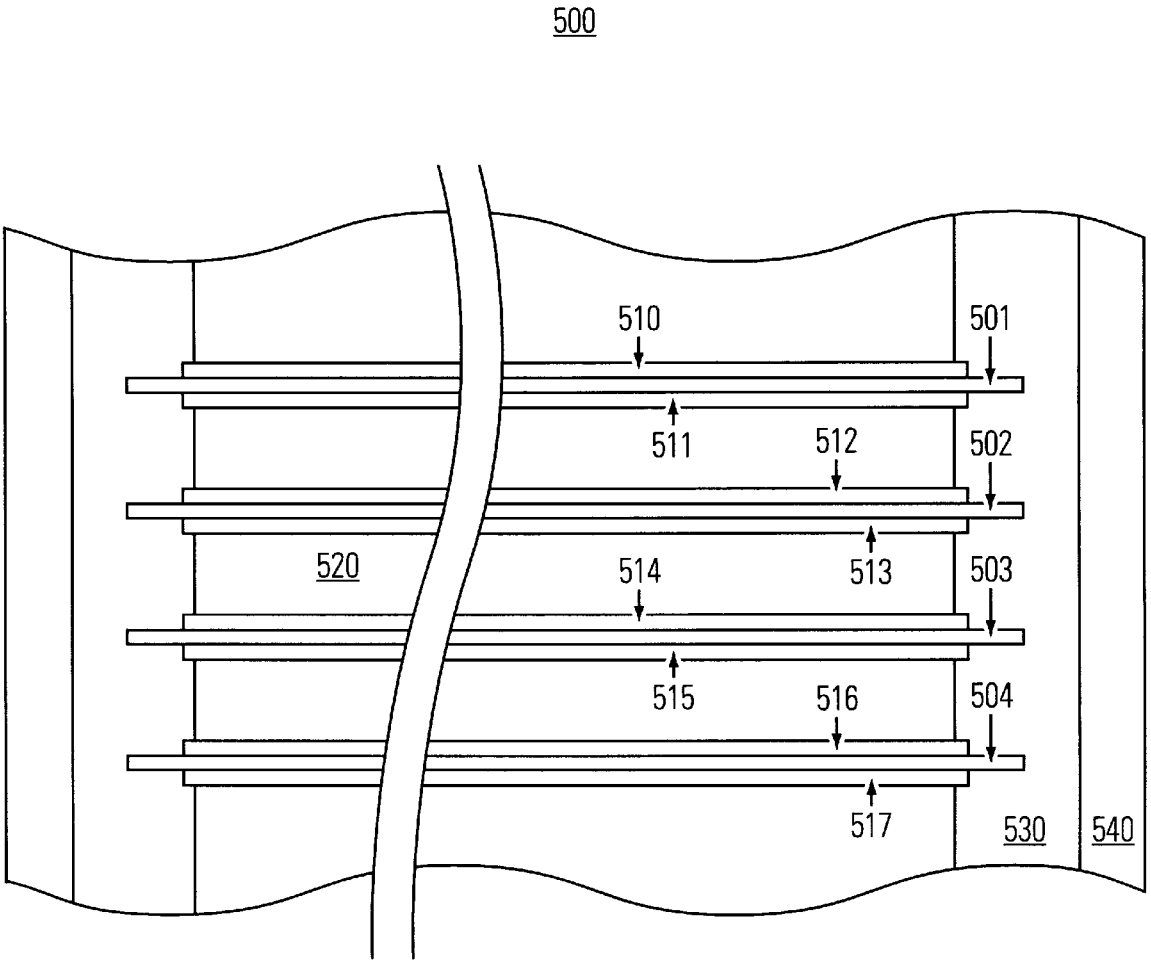
FIG. 5A is a top view illustrating walls attached to a faceplate in accordance with the present claimed invention.

In another embodiment of the present invention, faceplate 500 includes supporting structures which includes grippers 510–517 which support walls 501–504 of FIG. 5A. In this embodiment screen structure 530 is deposited over glass plate 540 and grippers 510–517 are formed over screen structure 530 such that they extend across active area surface 520. The sides of grippers 510–517 are spaced such that the distance between each opposing gripper allows for the insertion of one of walls 501–504 therebetween. Grippers 510–511 form a supporting structure which extends parallel to the longitudinal axis of wall 501 and are disposed on each side of wall 501 such that grippers 510–511 mechanically hold wall 501 perpendicular to the top surface of faceplate 500. Similarly, grippers 512–513 mechanically restrain wall 502, grippers 514–515 mechanically restrain wall 503, and grippers 516–517 mechanically restrain wall 504. Hence, the present invention does not require feet as are required in prior art flat panel displays, thereby reducing or eliminating the required border area. This reduces manufacturing costs, gives greater throughput, better yield, and a larger active area for a given size of glass plate.

In one embodiment, grippers 510–517 of FIG. 5A are integrally formed within screen structure 530 by the deposition, mask, and etch or development of multiple layers of conductive and dielectric materials. In this embodiment, grippers such as grippers 510–511 of FIG. 5B extend from screen structure 530. Grippers 510–511 are located such that wall 501 fits therebetween, thereby supporting wall 501 in a vertical position. Phosphor well 550 is shown to be formed over glass plate 540 within active area surface 520 of faceplate 500.

Figure 5B:
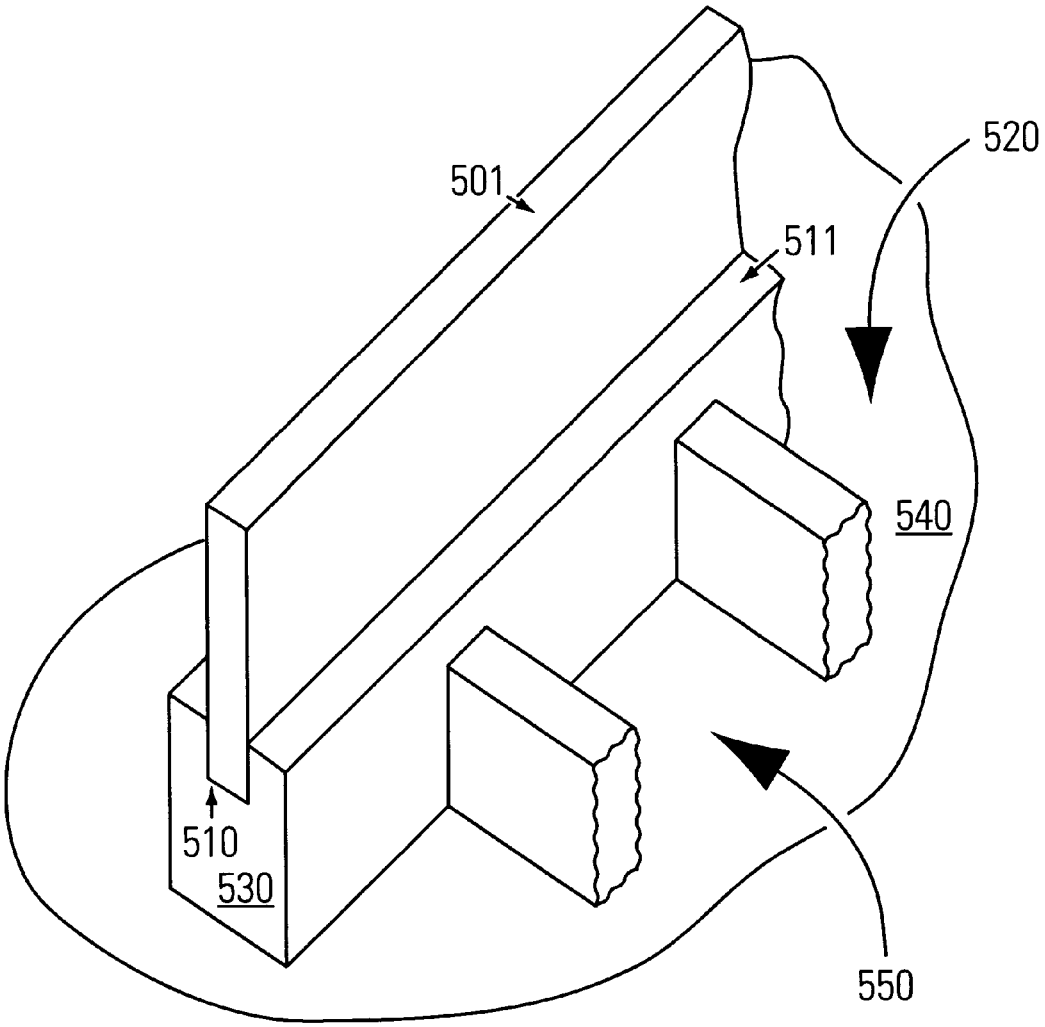
FIG. 5B is a perspective view illustrating a wall attached to a faceplate in accordance with the present claimed invention.
Figure 5C:
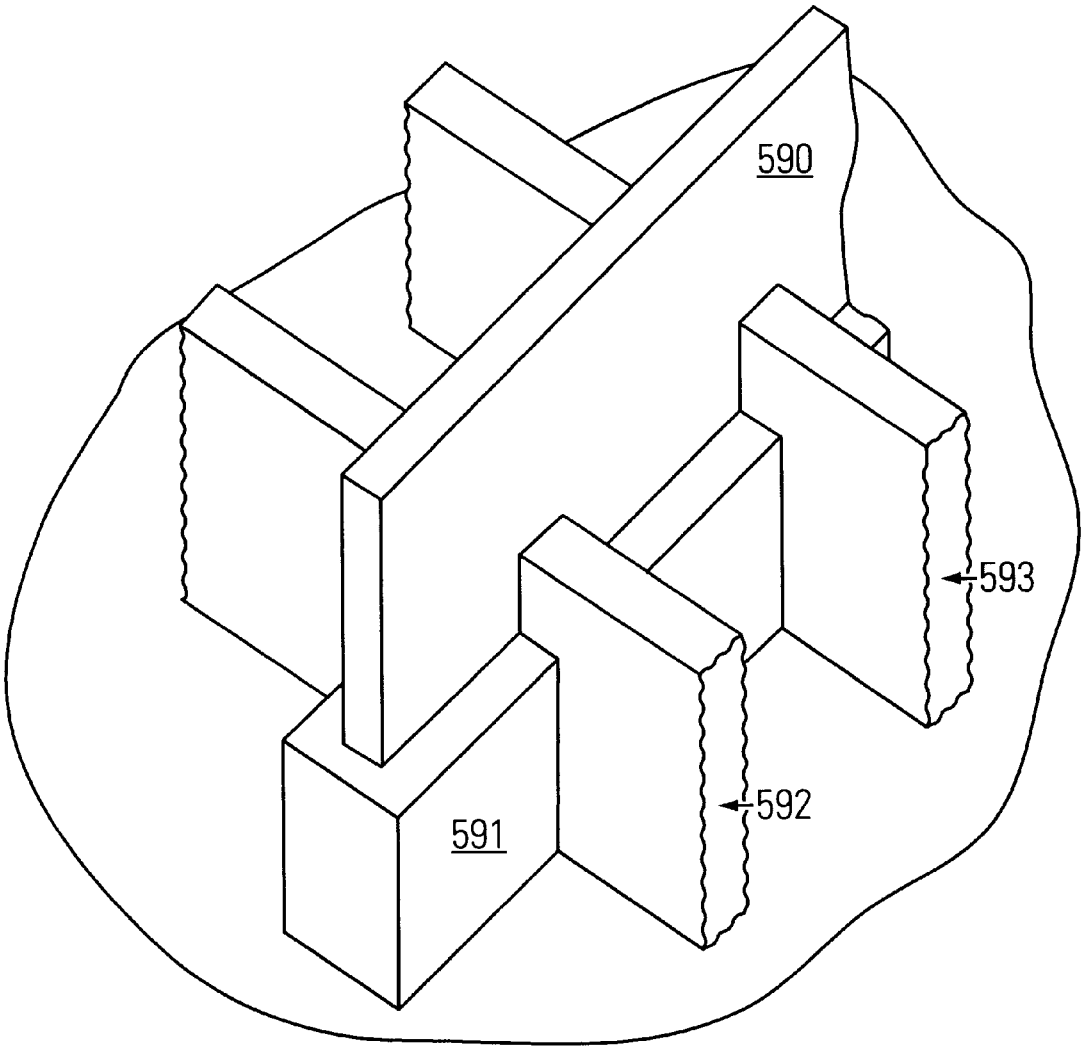
FIG. 5C is a perspective view illustrating a wall attached to a faceplate in accordance with the present claimed invention.

In another embodiment, the structure shown in FIG. 5C is used to support wall 590 in a vertical position. In this embodiment, wall 590 lies above screen structure 591 and grippers 592 and 593 include corresponding slots which receive wall 590, thereby supporting wall 590 in a vertical position.

Figure 6A:
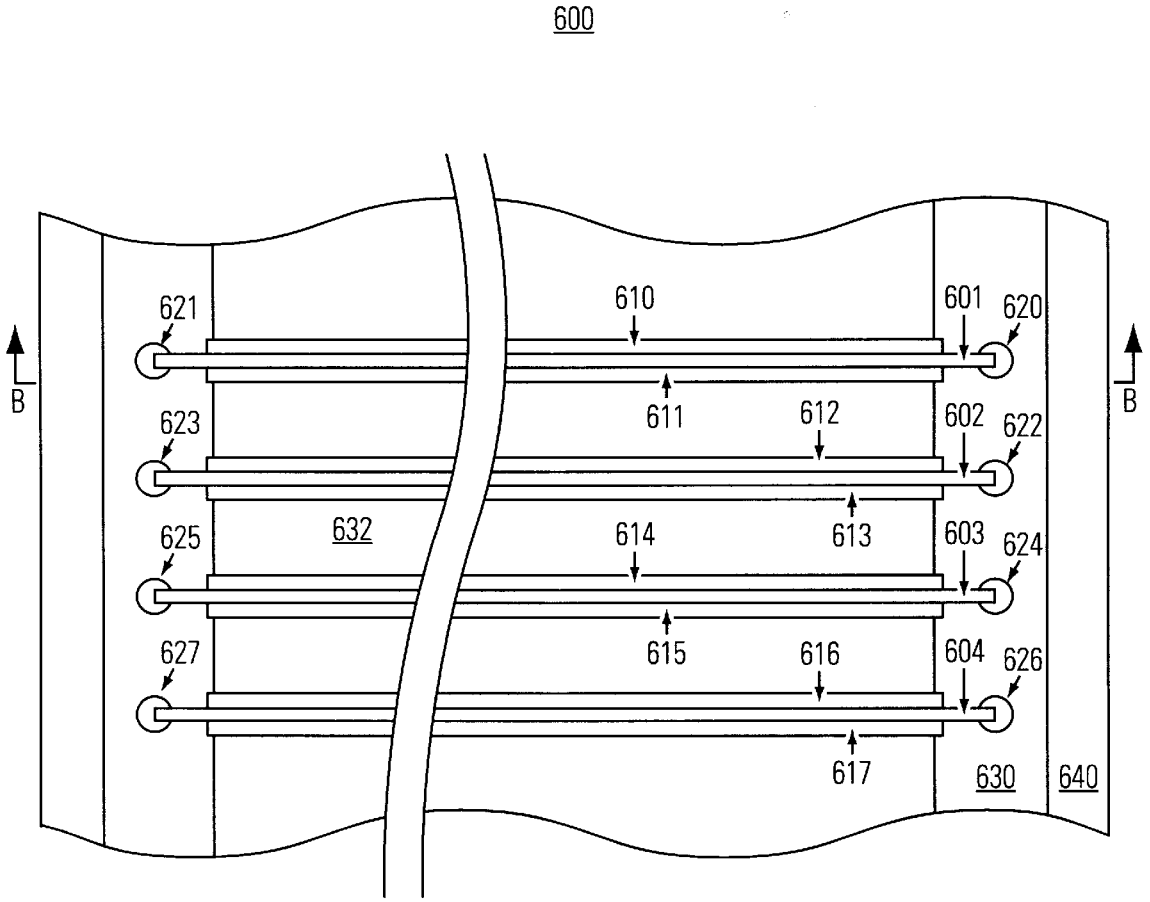
FIG. 6A is a top view illustrating walls attached to a faceplate in accordance with the present claimed invention.
Figure 6B:
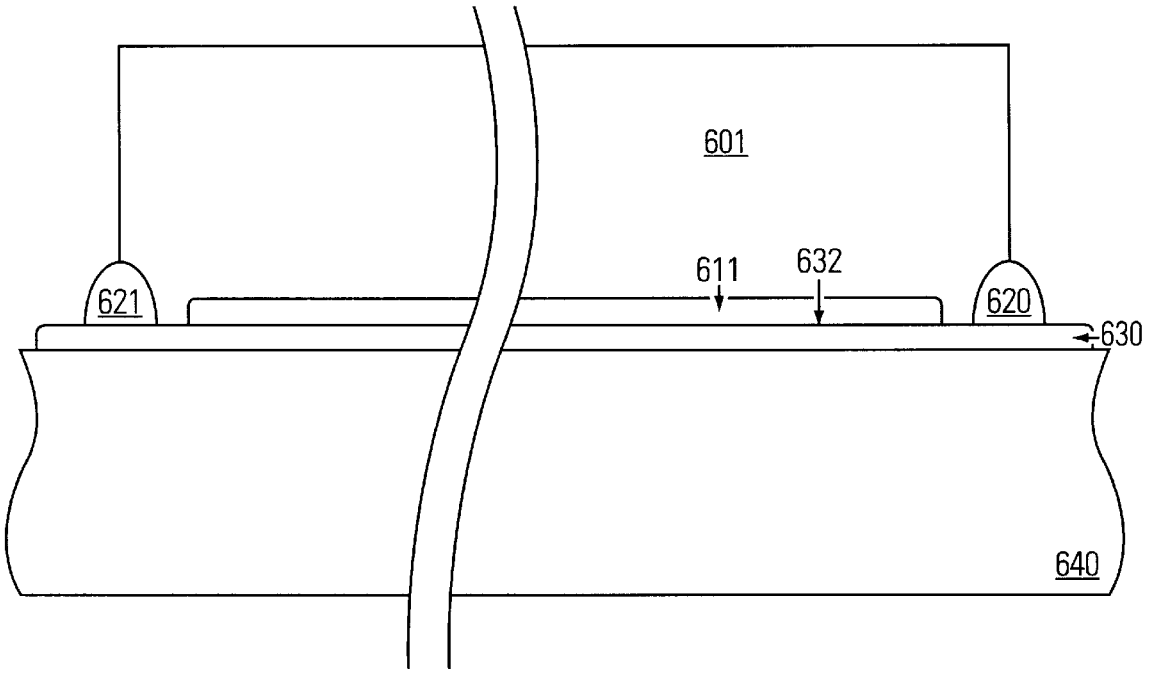
FIG. 6B is a cross sectional view along axis B—B of FIG. 6A illustrating a wall which is attached to a faceplate in accordance with the present claimed invention.

In an alternate embodiment of the present invention, walls 601–604 are attached to faceplate 600 of FIGS. 6A–6B using both grippers 610–617 and adhesive. In one embodiment, an adhesive which is UV curable is deposited on both ends of each of walls 601–604 so as to form adhesive drops 620–627. Wall 601 is supported by both grippers 610–611 and drops 620–621. Similarly, wall 602 is supported by both grippers 612–613 and drops 622–623. In the same manner, walls 603 and 604 are supported by grippers 614–617 and are secured by drops 624–627. Grippers 610–617 are formed over structure 630 which is formed over glass plate 640. Structure 630 includes active area surface 632 within which phosphor is deposited. Since the present invention does not require feet as are required in prior art flat panel displays, the border area requirement for walls is reduced or eliminated. This reduces manufacturing costs, gives greater throughput, better yield, and a larger active area surface for a given size of glass plate.

FIG. 6B shows a cross sectional view of the structure shown in 6A along axis B—B. In one embodiment, layer 630 is formed of polyimide and has a height of 10 to 25 microns. Gripper 611 is also formed of polyimide and has a height of approximately 38 to 60 microns. Alternatively, preformed adhesive blocks such as preformed adhesive blocks 410–417 of FIG. 4 could be used in place of drops 620–627. By using preformed adhesive blocks, the present invention does not require feet as are required in prior art flat panel displays, reducing or eliminating the required border area. In addition, since preformed adhesive blocks are easy and inexpensive to fabricate, manufacturing costs are reduced. Moreover since there is no need to manufacture feet, the present invention gives greater throughput, better yield, and a larger active area surface for a given size of glass plate.

Figure 7:
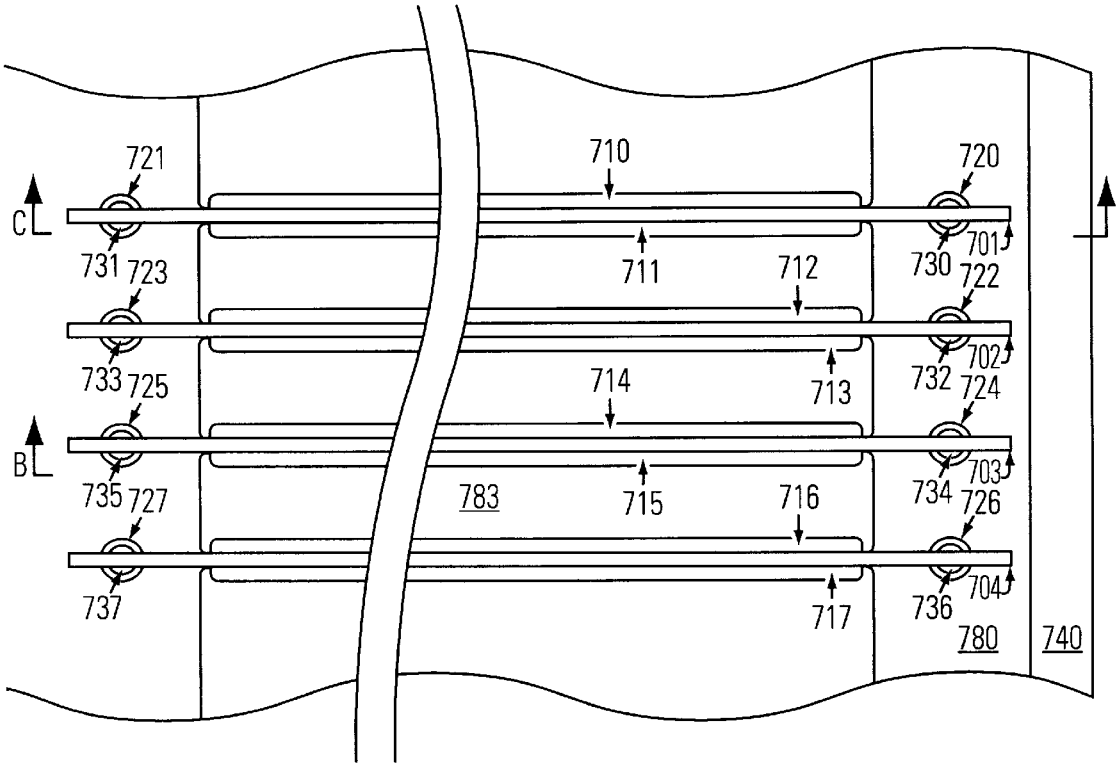
FIG. 7 is a top view of a flat panel display in accordance with the present claimed invention.
Figure 8:
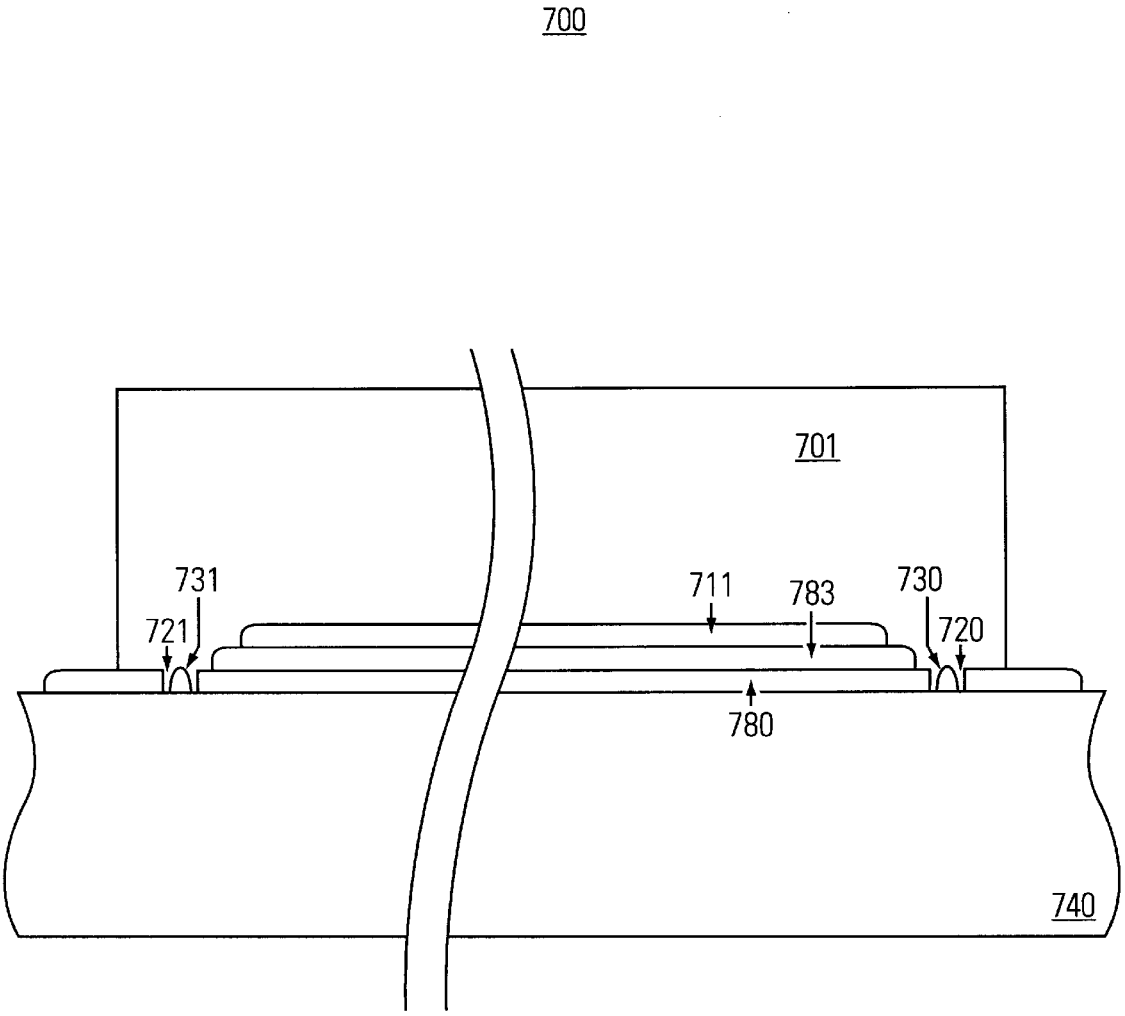
FIG. 8 is a cross sectional view along axis C—C of FIG. 7 illustrating a wall which is attached to a faceplate in accordance with the present claimed invention.

FIGS. 7–8 show another embodiment which secures walls onto faceplate 700 using both grippers and adhesive. In the embodiment shown in FIGS. 7–8, reservoirs 720–727 are formed within structure 780. In one embodiment structure 780 is formed of polyimide. Walls 701–704 are securely held in place by grippers 710–717 and adhesive drops 730–737. That is, wall 701 is secured by grippers 710–711 and adhesive drops 730–731. Similarly, walls 702–704 are secured by grippers 712–717 and adhesive drops 732–737. Structure 780 includes layer 783 which has an active area surface formed therewithin. Reservoirs 720–727 are formed outside of layer 783 such that adhesive drops 730–731 do not contact the active area surface.

With reference to FIG. 8, wall 701 overlies glass plate 740 and is attached thereto by adhesive drops 730–731. Reservoir 720 contains adhesive drop 730 and reservoir 721 contains adhesive drop 731. Layer 783 overlies structure 780 and has a channel formed therein for receiving wall 701 such that wall 701 is supported by gripper 711 and layer 783. This structure may be obtained by depositing layer 783 and then depositing a layer thereover and masking and developing so as to form the structure of gripper 711 and to form a trench which extends through gripper 711 and through layer 783. By using reservoirs, the problems associated with the adhesive wicking under the walls is eliminated. Alternatively, structure 780 and layer 783 may be combined into one layer.

In an embodiment that uses glass frit to bond walls, a laser may be used to melt the glass frit so as to bond the walls. In such an embodiment, a low temperature glass frit is used. In this embodiment, a relatively low substrate heating (e.g. 200 degrees centigrade) is required, compared to conventional oven heating of glass frit at 450 degrees centigrade. The heating of sintered glass frit by laser will have sufficient integrity to sustain later high temperature process steps. In one embodiment, an infrared diode laser or a Nd:YAG (1.06 micrometer) laser is used to bond walls using glass frit.

In one embodiment of the present invention, the low temperature glass frit is formed by mixing approximately 2 percent to 4 percent by weight Q-pac organic compound with NEG low temperature glass. Q-pac organic compound may be purchased from Pac Polymer of Delaware and NEG low temperature glass may be purchased from Nippon Electrical Glass of Ostu, Japan. The resulting low temperature glass frit has a bias temperature of 200 degrees centigrade.

Figure 9:
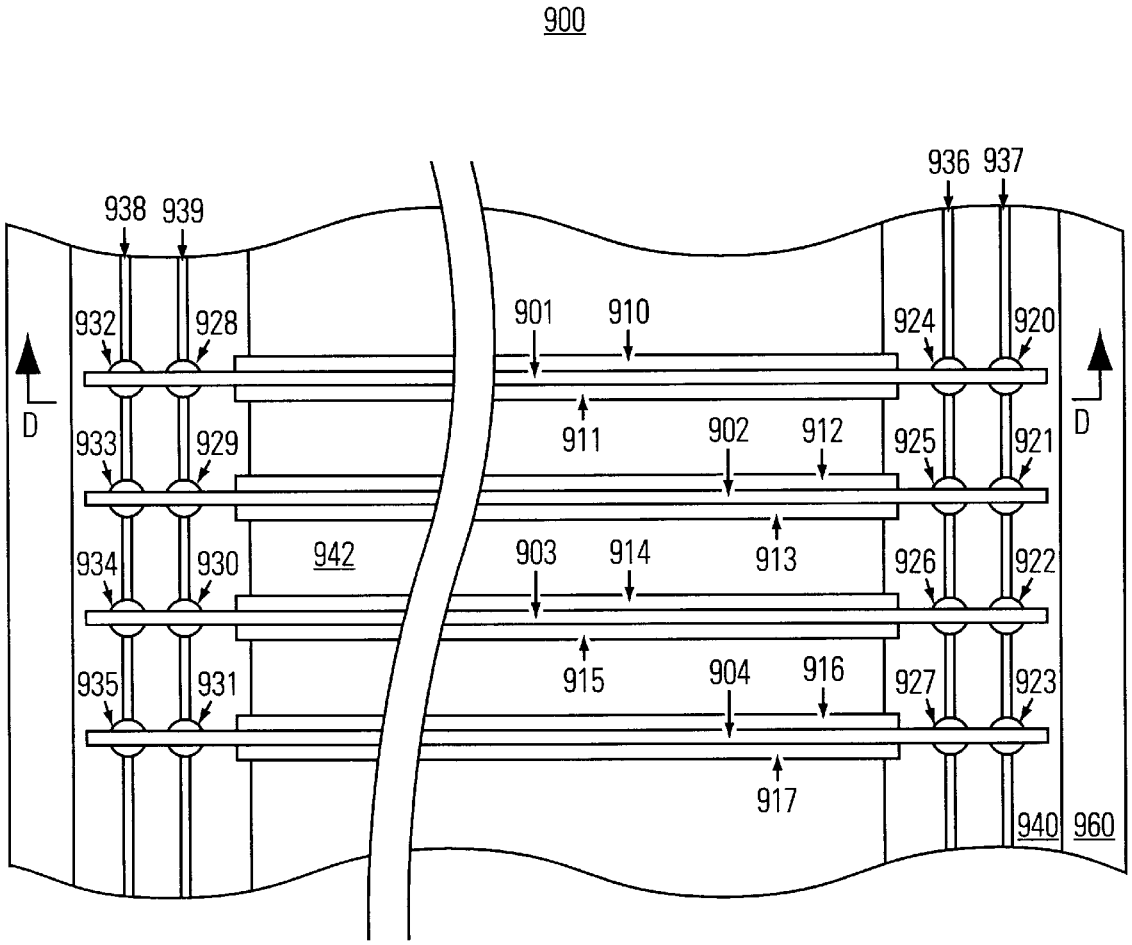
FIG. 9 is a top view illustrating walls attached to a faceplate in accordance with the present claimed invention.
Figure 10A:
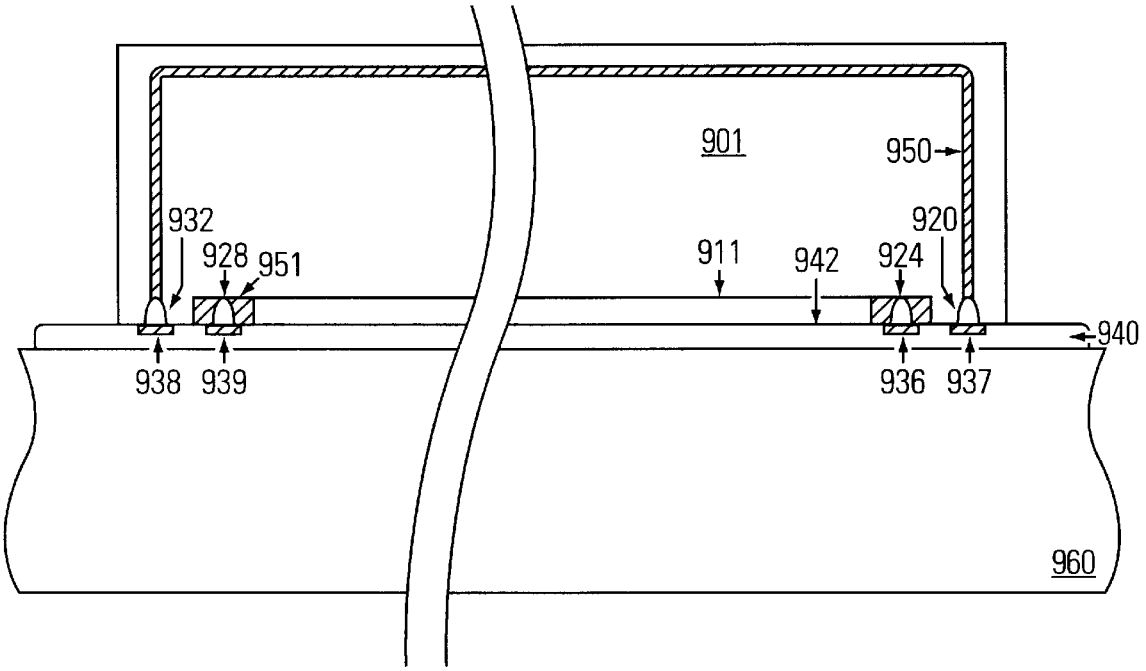
FIG. 10A is a side cross sectional view along axis D—D of FIG. 9 illustrating a wall which is attached to a faceplate in accordance with the present claimed invention.

FIGS. 9–10A illustrate an embodiment in which grippers 910–917 and conductive bonds 920–935 are used to secure walls 901–904 to faceplate 900. In this embodiment conductive material is used to form conductive bonds 920–935 of FIG. 9. In one embodiment, a bonding material is used to form bonds 920–935. A low temperature heating process is then used to melt the conductive material so as to weld walls 901–904 to conductive lines 936–939. Conductive bonds 920–935 secure walls 901–904 and make electrical contact between conductive strips formed within each wall and conductive lines 936–939. Alternative heating processes include using a focused laser, using an infrared lamp, using hot air, using ultrasonic bonding methods, or applying heat by heating the device which places the walls into their proper position (the end effector).

In one embodiment, conductive lines 936–939 of FIG. 9 are formed of gold and the edges of walls 901–904 are coated with indium where they contact conductive lines 936–939 such that bonds 920–935 are formed by low temperature transient liquid phase bonding. Alternatively, low temperature transient liquid phase bonding using indium and silver or indium, lead, silver and gold, or indium, tin, and gold could be used. In the low temperature transient liquid phase bonding process, a heating step is carried out at between 60 degrees and 160 degrees centigrade so as to melt the indium and the gold. The metals used in low temperature transient liquid phase bonding combine so as to form an alloy which has a substantially higher re-melting temperature. Thus, bonds 920–935 are formed such that they do not melt during high temperature processes steps. In one embodiment, a low temperature transient liquid phase bonding is performed using 52 percent indium and 48 percent gold which is melted at approximately 118 degrees centigrade so as to form bonds that have a re-melting temperature of over 400 degrees centigrade.

In another embodiment conductive lines 936–939 of FIG. 9 are covered with a brazing paste which is heated to form bonds 920–935. In one embodiment, an eutectic gold and copper alloy is used to form the brazing paste. In this embodiment, the brazing paste is heated to a temperature of 140–240 degrees centigrade.

FIG. 10A shows wall 901 to include conductive strips 950–951 that extend across the top and the bottom, respectively, of wall 901. Conductive lines 936–939 are formed within structure 940. Structure 940 also includes active area surface 942. Gripper 911 extends from the top surface of structure 940 so as to support wall 901.

Figure 10B:
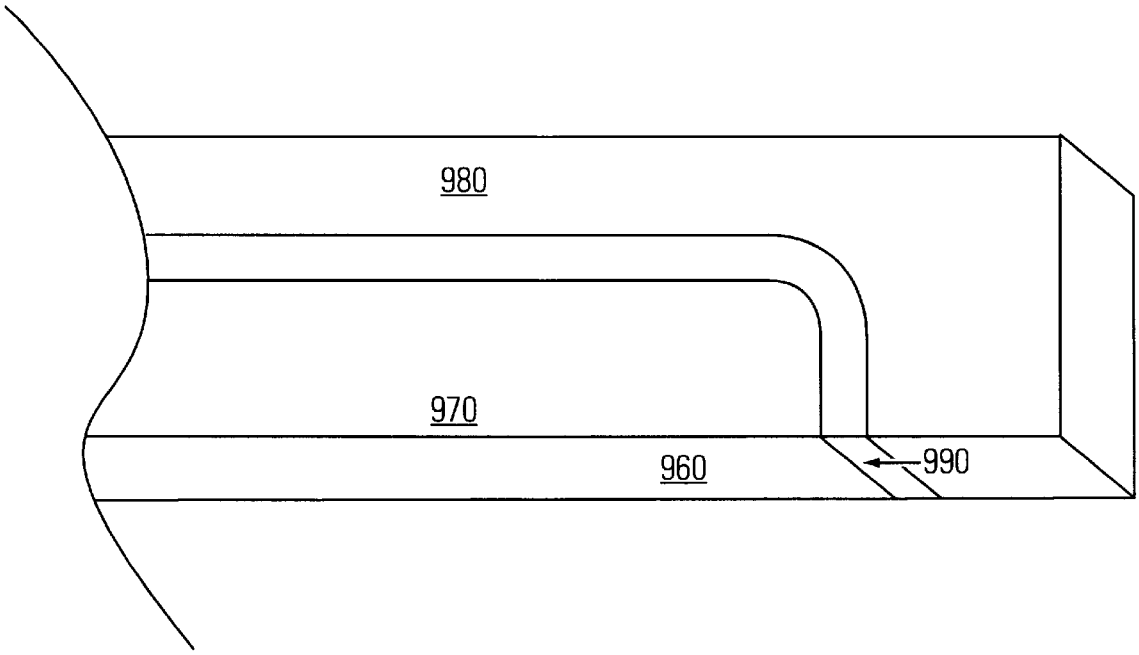
FIG. 10B is a perspective view of a wall in accordance with the present invention.

Alternatively, only one conductive strip could be formed on a particular wall. FIG. 10B shows an embodiment in which wall 980 includes conductive strip 990 which extends across side surface 970 and across bottom surface 960.

Figure 11:
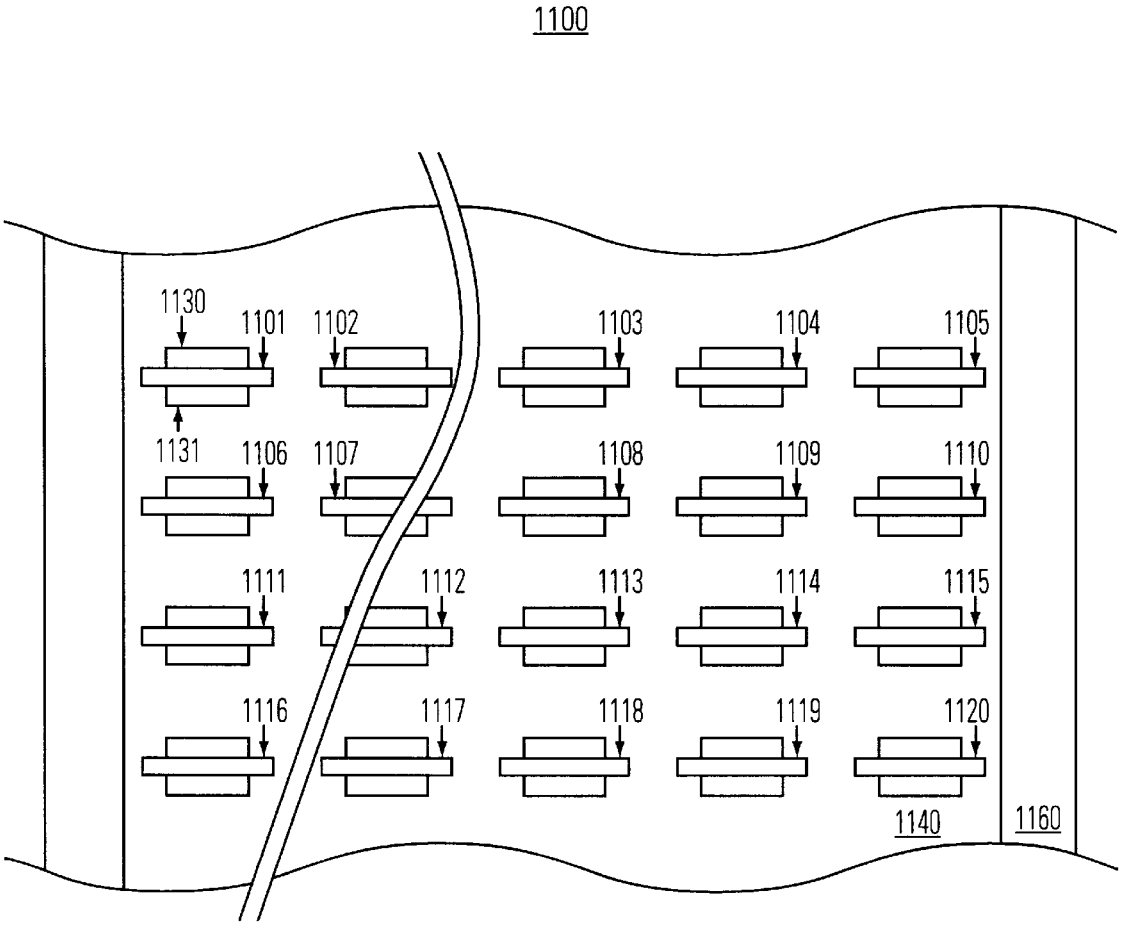
FIG. 11 is a top view illustrating wall segments attached to a faceplate in accordance with the present claimed invention.

FIG. 11 illustrates an alternate embodiment which includes wall segments 1101–1120 which are disposed within the active area surface 1140 of faceplate 1100. Wall segments 1101–1120 do not extend completely across active area surface 1140 as do walls shown in FIGS. 1–10. Instead, wall segments 1101–1120 are shorter such that multiple wall segments may be disposed across active area surface 1140 lengthwise. Gripper segments such as, for example, gripper segments 1130–1131 support wall segments 1101–1120. Faceplate 1100 includes active area surface 1140 formed over glass plate 1160. By using wall segments 1101–1120, the border region defined by the space between active area surface 1140 and the edges of glass plate 1160 may be reduced. This allows for a wider display area (active area) for each size of faceplate since there is no need to allow space for extending and attaching walls.

Alternatively, wall segments may be attached using conductive material so as to make electrical contact between wall segments with or without edge metal and conductive lines or a conductive surface located on the faceplate. In one embodiment, wall segments are resistive so as to allow electrons striking the wall segment to "bleed off" by traveling along the conductive lines located on the faceplate to the power supply. In one embodiment, walls are made from resistive material. Alternatively, walls may be formed using a material which is an insulator which is coated with a resistive coating.

In another embodiment, a conductive strip is formed on each wall segment which is connected to the electrical circuits of the faceplate by conductive bonds. In the embodiment shown in FIG. 12A, conductive strip 1202 is formed on wall segment 1201 such that it partially extends across the bottom of side surface 1204 and the bottom surface 1206 of wall segment 1201. Wall segment 1201 is made of a resistive material such that electrons striking the wall segment "bleed off" by traveling through conductive strip 1202 which is electrically connected to the power supply.

Figure 12A:
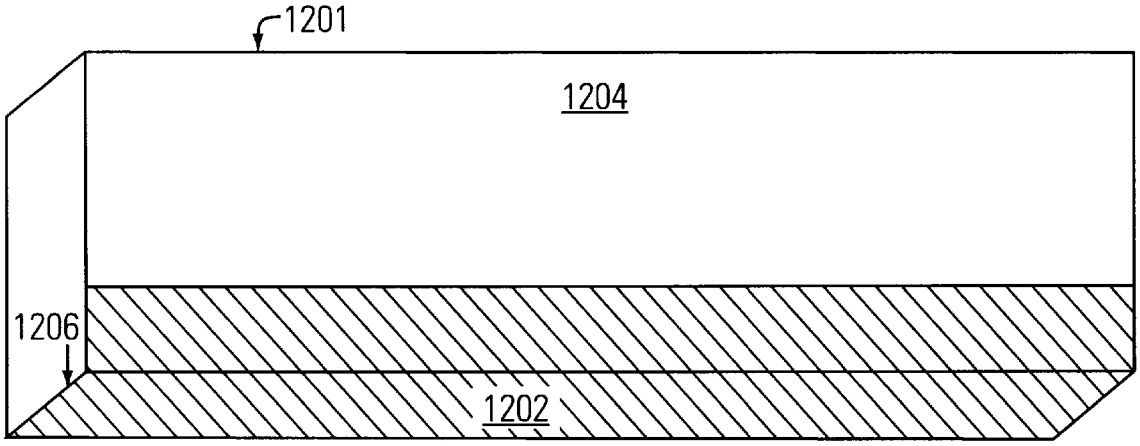
FIG. 12A is a perspective view of a wall segment in accordance with the present claimed invention.
Figure 12B:
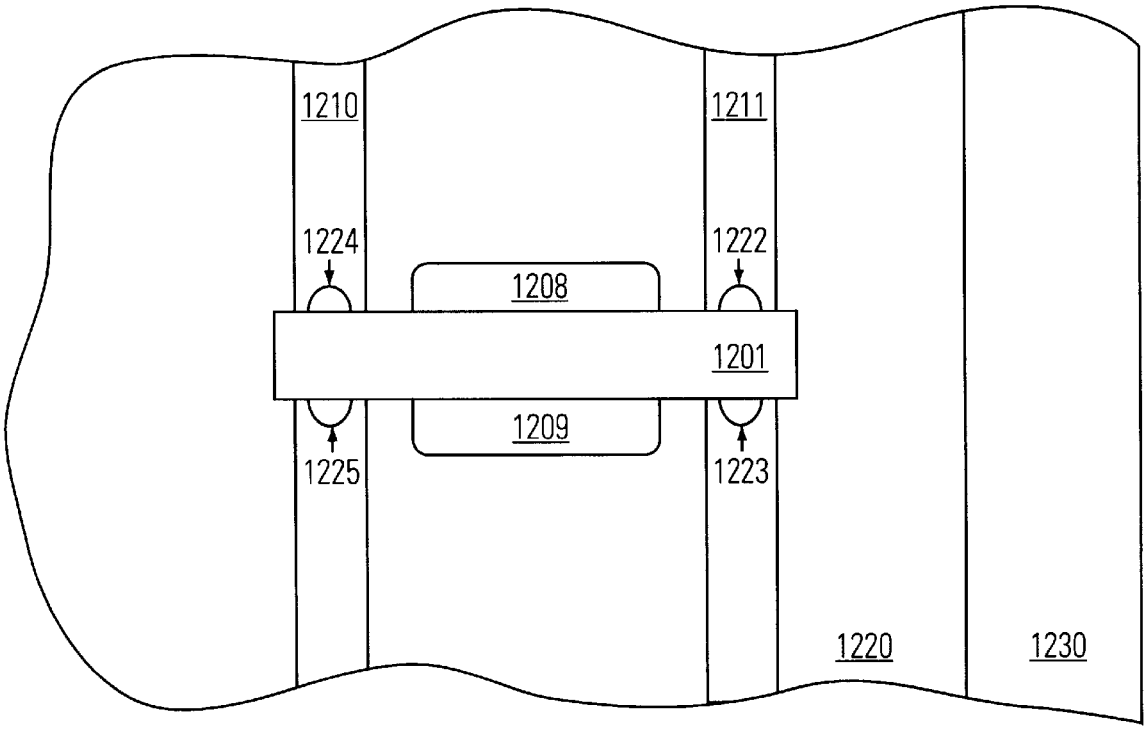
FIG. 12B is an expanded top view illustrating a wall segment attached to a faceplate in accordance with the present claimed invention.

With reference to FIG. 12B, wall segment 1201 is supported by gripper segments 1208–1209 and is attached to electrically conductive lines 1210–1211 by conductive bonds 1222–1225. Conductive lines 1210–1211 are formed within active region 1220 of faceplate 1230. In one embodiment conductive lines 1210–1211 are formed during the process of forming gripper segments 1208–1209 by exposing an underlying conductive layer so as to form conductive lines 1210–1211. In one embodiment, the conductive material used to form conductive bonds 1222–1225 consists of eutectic mixture of two or more materials that have a low melting point and which have a high melting point once they are mixed together with the contact pad material as they are melted. In one embodiment conductive bonds are formed by an eutectic solder. Alternatively, conductive bonds are formed using an eutectic brazing process. In an alternate embodiment, conductive glass frit or conductive UV curable adhesive could be used to form conductive bonds 1203–1204.

Though wall segment 1201 of FIGS. 12A–12B is shown to be bonded with reference to four bonds, alternatively, any number of bonds could be used and connection could be to any of a number of strips. With reference to contact with a conductive region, any of a number of bonds could be made to the conductive region. For example, wall segment 1201 could be connected using a single bond to a single conductive strip (not shown). In addition, though wall segment 1201 is shown to be supported by both grippers and conductive bonds, alternatively, wall segment 1201 could be supported entirely by conductive bonds such as conductive bonds 1203–1204 or entirely by grippers. Grippers could be either parallel or perpendicular to wall segment 1201.

Figure 13:
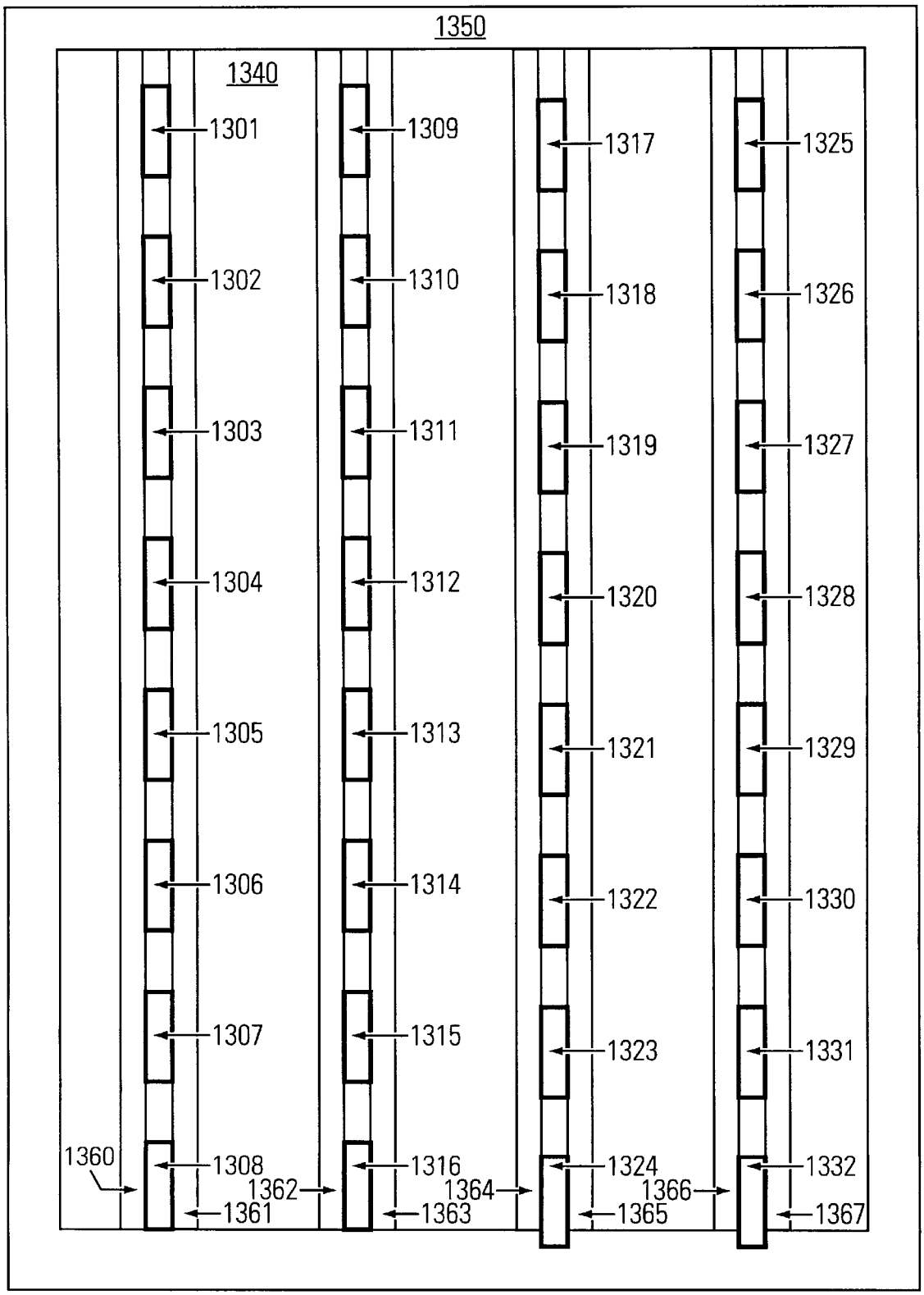
FIG. 13 is a top view illustrating wall segments attach to a faceplate in accordance with the present invention.

FIG. 13 shows an embodiment in which wall segments 1301–1332 are used in combination with grippers 1360–1367 that extend across active area surface 13 of faceplate 1360. Grippers 1360–1367 and wall segments 1301–1332 are shown as running vertically with reference to faceplate 1350. Gripper 1360 and gripper 1361 support walls 1301–1308. Similarly, grippers 1362–1363 support wall segments 1309–1316. Grippers 1364–1365 support wall segments 1317–1324 and grippers 1366–1367 support wall segments 1325–1332.

Another bonding method which may be used to bond walls or wall segments to the faceplate is anodic bonding. In an embodiment using an anodic bonding process, walls are formed of silicon and they are bonded directly to the glass surface of the faceplate. A high electric field is applied across the joint between the glass and the silicon wall. The wall is pressed against the glass and heat is applied. This combination of heat, pressure, and electric field causes the molecules of the materials to diffuse into each other so as to form a strong bond. The presence of the electric field reduces the heat and pressure required to form a bond, thereby easing the manufacturing process. Alternatively, an anodic bond may be formed between a wall and the surface of a faceplate when the surface is not glass and the wall is not silicon by coating the surface of the wall to be bonded with a suitable bonding material and applying an anodic bonding material to the faceplate. In one embodiment, the bottom surface of each wall is coated with silicon and glass frit is deposited over the surface of the faceplate and heat, pressure, and an electric field is applied so as to form an anodic bond. Alternatively, any combination of materials that will bond using an anodic bonding process may be used to form an anodic bond.

A wire bond connector may be attached to conductive segments formed on a spacer and attached to conductive lines or conductive regions on either a faceplate or on a backplate so as to make electrical contact between the conductive segments formed on the spacer and the faceplate or the backplate. In one embodiment, the wire bond connector is a short segment of wire formed of a conductive material.

Though the grippers, gripper segments, walls, and bonding structures of the present invention are shown to be disposed on the faceplate, they are also well suited to be disposed on the backplate. In addition, though walls, wall segments, grippers and gripper segments are shown to be running either horizontally or vertically, each embodiment may run either horizontally or vertically. Also, though electrical contact with wall segments is described with reference to contact with conductive lines located on the faceplate, electrical contact could also be made to a conductive region on the faceplate such as the anode area metal. The present invention is also well suited to providing contact between wall segments and a conductive region located on the backplate. In addition, slots formed by supporting structures such as grippers may be either slightly wider or narrower than the width of the wall or wall segment to be disposed therewithin.

Since the embodiments of the present invention shown in FIGS. 1–13 do not require feet, thus, in the embodiments shown in FIGS. 1–10B, the border requirement is greatly reduced, with a reduction in the order of one to ten millimeters. In the embodiments shown in FIGS. 11–14 which use wall segments, border requirements for walls are eliminated entirely. In addition, the expensive and costly steps of forming feet on each wall is eliminated, resulting in increased yield, increased throughput, and reduced cost of manufacturing.

Figure 14:
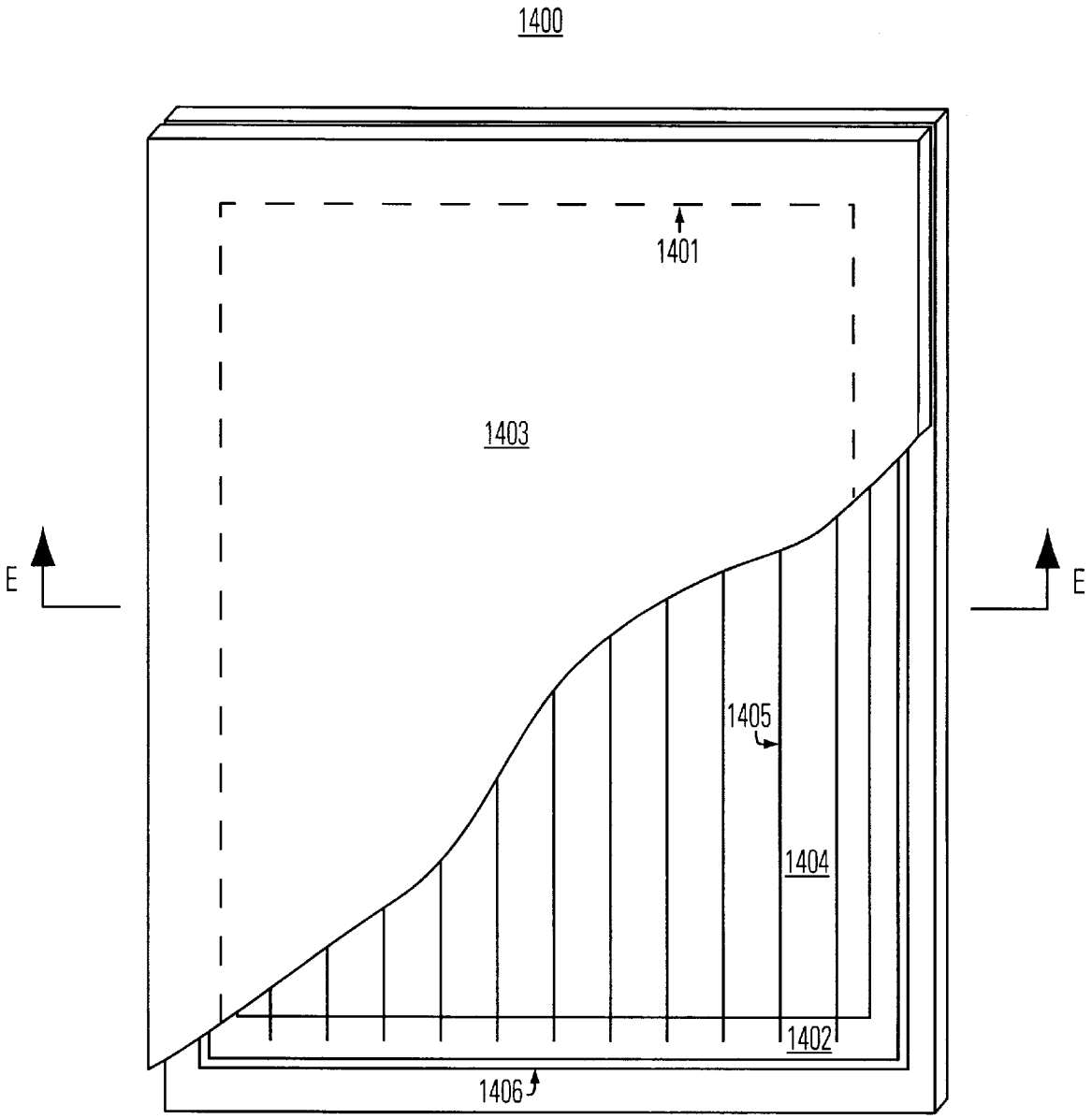
FIG. 14 is a top cut-away perspective view of a flat panel display having walls with improved thermal conductivity and decreased thermal coefficient of resistivity in accordance with the present claimed invention.
Figure 15:
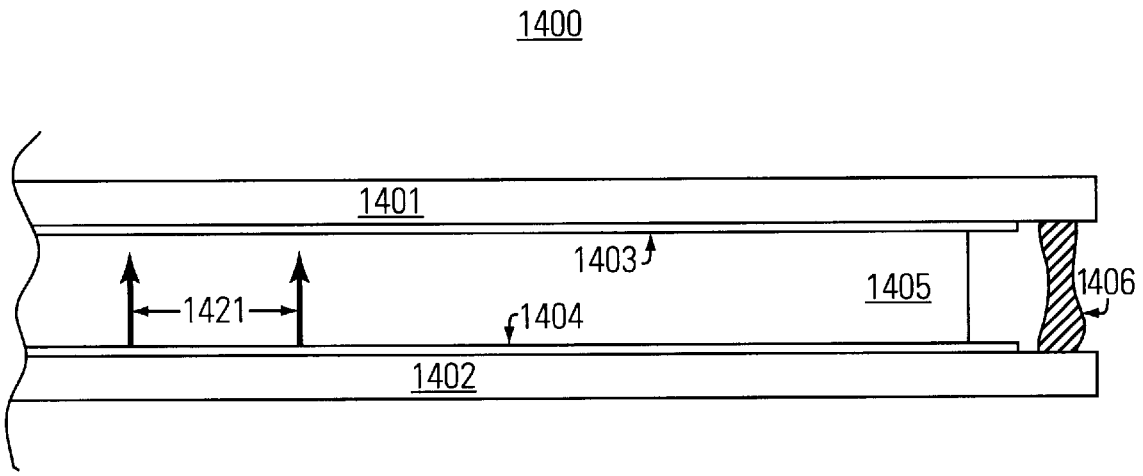
FIG. 15 is a side cross sectional view along axis E—E of FIG. 14 illustrating a flat panel display having walls with improved thermal conductivity and decreased thermal coefficient of resistivity in accordance with the present claimed invention.
Figure 16:
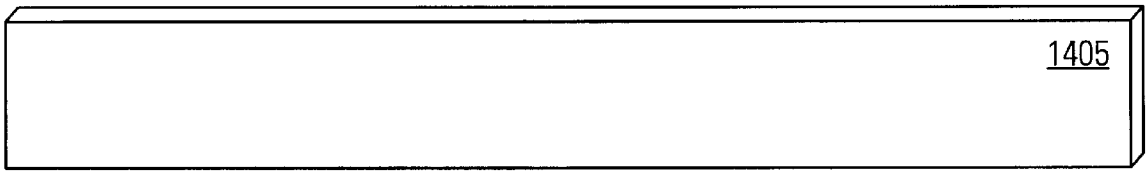
FIG. 16 is a front perspective view illustrating a wall having improved thermal conductivity and decreased thermal coefficient of resistivity in accordance with the present claimed invention.

In the embodiment of the present invention shown in FIGS. 14–16, a flat panel display is shown that includes walls having improved thermal conductivity and decreased thermal coefficient of resistivity. Referring now to FIG. 14, flat panel display 1400 is shown to include a faceplate 1401. Faceplate 1401 is a glass plate onto which successive layers of material have been deposited so as to form active area surface 1403. Active area surface 1403 includes one or more areas of phosphor. Flat panel display 1400 also includes backplate 1402 that includes active area surface 1404. Faceplate 1401 is attached to backplate 1402 by seal 1406 that extends around the periphery of active area surface 1403 and active area surface 1404 so as to form an enclosure around active area surface 1403 and active area surface 1404. In one embodiment of the present invention, seal 1406 is formed by melting glass frit. Walls, shown generally as wall 1405, extend vertically between faceplate 1401 and backplate 1402.

With reference now to FIG. 15, wall 1405 is shown to extend vertically between faceplate 1401 and backplate 1402 so as to give uniform spacing between faceplate 1401 and backplate 1402. In one embodiment of the present invention, backplate 1402 of FIG. 15 is formed with an active area surface 1404 which includes a cathodic structure that includes emitters that emit electrons, such as exemplary electrons 1421, in the direction of face plate 1401. These electrons strike phosphor areas within active area surface 1403 so as to emit light, generating a visible display.

FIG. 16 shows an embodiment in which wall 1405 has an elongated rectangular shape. However, any of a number of different shapes may be used. For example, posts, pins, and wall segments could also be used. In one embodiment of the present invention, wall 1405 is formed of ceramic and refractory metal, with particles of refractory metal dispersed in the ceramic. In one embodiment, molybdenum is used. However, other refractory metals could also be used such as, for example, niobium, tungsten, and nickel. In one embodiment, a mixture of 90 percent ceramic and 10 percent refractory metal is used. This gives a wall 1405 that has a high resistivity. Because wall 1405 is formed of ceramic and metal, wall 1405 has a high thermal conductivity and a low temperature coefficient of resistance. Because of the dissipation of heat and the uniform resistivity of the walls of the present invention, local non-linear voltage gradient along the walls due to thermal effects is reduced. This gives a visible display that does not include visible non–illuminated regions in the form of non-illuminated lines that extend across the visible display. Also, since the display of the present invention does not generate locally charged regions as a result of thermal effects, arcing resulting from thermal effects is eliminated. Thus, heating of faceplate 1401 does not produce non-illuminated regions in flat panel display 1400 of FIGS. 14–15.

Figure 17:
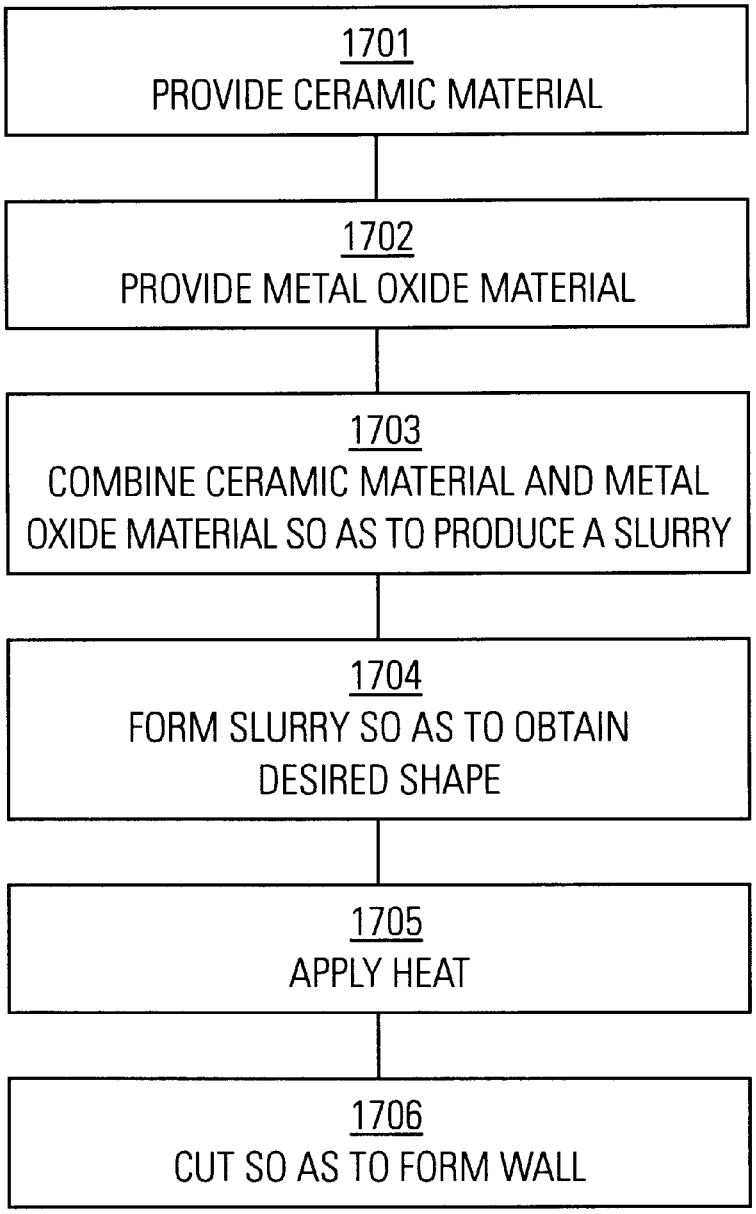
FIG. 17 is diagram showing a method for forming a wall having improved thermal conductivity and decreased thermal coefficient of resistivity in accordance with the present claimed invention.

Referring now to FIG. 17, a method for forming a wall according to one embodiment of the present invention is shown. First, ceramic material is provided as shown by step 1701. In one embodiment, the ceramic material consists of ninety eight percent (98%) alumina and two percent (2%) titania. Alternatively any of a number of other ceramic materials having a high resistivity could be used.

Continuing with FIG. 17, metal oxide material is provided as shown by step 1702. In one embodiment, the metal oxide is molybdenum trioxide. However, any of a number of other metal oxides could be used such as, for example, niobium pentoxide, tungsten trioxide, or nickel oxide. Alternatively, other materials such as, for example, aluminum nitride, magnesium oxide, or berillium oxide can be separately used to increase the thermal conductivity of walls.

The ceramic material and the metal oxide material is combined so as to produce a slurry as a shown by step 1703 of FIG. 17. In one embodiment, a commercial mixer is used to combine the materials and evenly disperse the metal oxide material within the mixture.

This slurry is formed so as to obtain a desired shape as shown by step 1704 of FIG. 17. In one embodiment, the slurry is formed using a tape casting process. In the tape casting process, the mixture formed in step 1703 is cast as an organic tape. However, any of a number of different methods may be used to form a desired shape, such as, for example, extrusion, etc.

Still referring to FIG. 17, heat is then applied as a shown by step 1705 so as to form a piece of material having the desired material properties. The heating step removes the organic binder system. In addition, the heating process heats the metal oxide material so as to convert particles of metal oxide material into refractory metal particles. The heating step also sinters the mixture. In an embodiment where the slurry is formed into a shape using a tape casting process, the heating process results in a thin sheet of material.

Continuing with FIG. 17, the piece of material is then cut so as to form a completed wall as shown by step 1706. In one embodiment, a dicing process is performed so as to cut the piece of material into multiple thin walls. In the embodiment, where a tape casting process is used, the thin sheet of material is cut into thin strips of material which are used as walls.

In one embodiment, wall 1405 of FIGS. 14–16, walls 103–120 of FIGS. 1–3, walls 402–405 of FIG. 4, walls 501–504 of FIGS. 5A–5B, wall 590 of FIG. 5C, walls 601–604 of FIG. 6A–6B and walls 701–704 of FIGS. 7–8, are formed according to the steps of FIG. 17.

Figure 18:
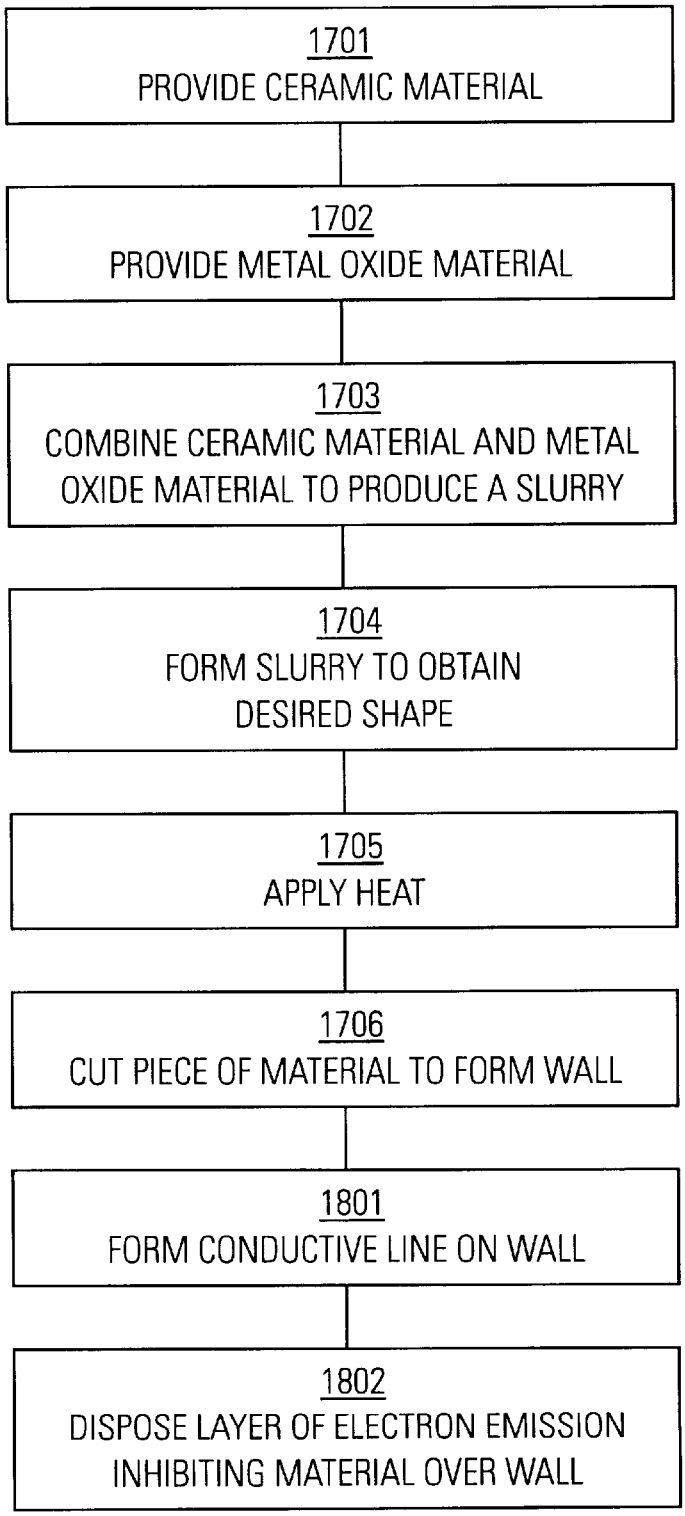
FIG. 18 is diagram showing a method for forming a wall having improved thermal conductivity, decreased thermal coefficient of resistivity, a conductive strip and an electron emission inhibiting layer in accordance with the present claimed invention.

Reference now to FIG. 18, a method for forming a wall that includes a conductive strip and a layer of electron emission inhibiting material is shown. First, a wall is formed using the steps shown in FIG. 17. That is, ceramic material is provided (step 1701), metal oxide material is provided (step 1702), and the ceramic material and metal oxide material are combined so as to produce a slurry (step 1703). The slurry is then formed so as to obtain a desired shape (1704), heat is applied (step 1705), and the piece of material is cut (step 1706) so as to form a wall.

Still referring to FIG. 18, a conductive strip is then formed over the surface of the wall as is shown by step 1801. In one embodiment, the conductive strip is formed by the selective deposition of a thin strip of conductive material. In one embodiment, the conductive strip is formed of gold. Alternatively, any of a number of other conductive materials may be used. In one embodiment, multiple conductive strips are used. Referring back to FIG. 10A, conductive strips

950–951 can be formed according to step 1801. Alternatively, conductive strips such as conductive strip 990 of 10B could be formed.

Continuing with FIG. 18, the conductive strip(s) formed in step 1801 allow electrons striking the wall to "bleed off" by traveling along the conductive strip(s), and onto the backplate, where they travel to the power supply(not shown).

Next, a shown by step 1802 of FIG. 18, a layer of electron emission controlling material is disposed over the wall. In one embodiment, a thin coat of electron emission controlling material is sprayed over the surfaces of the wall.

The methods shown in FIGS. 17 and 18 may be used to make walls having any of a number of different sizes, shapes, and configurations. In an embodiment that uses wall segments, the methods of FIGS. 17 and 18 can be used to make wall segments such as, for example, wall segments 1101–1120 of FIG. 11, 1201 of FIG. 12A–12B and 1301–1332 of FIG. 13.

Walls fabricated according to the methods of FIGS. 17–18 have a thermal coefficient of resistivity that is lower than that of prior art walls. Also, walls fabricated according to the methods of FIGS. 17–18 have a thermal conductivity greater than that of prior art walls. Also, other material properties of spacers are either maintained or improved such as, for example, electrical resistivity, mechanical strength, high voltage breakdown strength, secondary electron emission coefficient, etc.

Walls fabricated according to FIGS. 17–18 include an appropriate size and distribution of metallic particles so as to promote electrical conduction by percolation, or tunneling transport. This reduces the thermal coefficient of resistivity of the resulting wall.

In one embodiment, a thin film of refractory metal oxide is generated from the dispersed metal phase on the surface of the wall. This results in a reduction of surface charging due to the lowering of the secondary electron emission coefficient. If the secondary electron emission coefficient is sufficiently reduced, a separate coating step to reduce secondary electron emission is not required.

It has been found that a ratio, referred to hereinafter as the visibility ratio governs whether not regions of a visible display will be non-illuminated as a result of thermal effects. The visibility ratio is equal to the thermal coefficient of resistivity divided by the thermal conductivity of the wall.

The thermal coefficient of resistivity of prior art walls is typically greater. than or equal to 3%/° C. (where C is temperature in degrees Centigrade) and the thermal conductivity of prior art walls is typically less than or equal to 5 W/m-° C. (where "W" is Watts and "m" is meters). This gives a visibility ratio for prior art walls of 0.6 (%-meter/Watt) or more. With this level of visibility ratio, as bright regions of a visible display heat up the faceplate, non-illuminated regions of the visible display can be seen.

The methods for making a wall of FIGS. 17–18 produce walls that have a temperature coefficient of resistivity that is less than or equal to 1.5%/° C. and a thermal conductivity that is greater than or equal to 50 W/m-° C. Thus, the walls of the present invention have a visibility ratio of approximately 0.03. Therefore, the visibility ratio of the present invention (0.03) is significantly less than the visibility ratio of prior art walls (typically 0.6 or greater). This reduced visibility ratio gives a flat panel display that does not have non-illuminated regions as a result of thermal effects.

In addition, walls fabricated according to the methods of FIGS. 17–18 maintain a high sheet resistivity (on the order of 2.5 E+11 ohms per square meter). Also, the walls of the present invention are easy to manufacture and the walls have a high compressive strength.

Though FIGS. 14–18 are described with reference to the use of wall, other types of support structures such as posts, wall segments, etc. could also be used. Also other material combinations can be used. In one alternate embodiment, an alumina-zirconia wall is used in conjunction with a faceplate that is silica-coated soda lime glass produced by a float process. The coefficent of thermal expansion of the wall is matched with the coefficient of thermal expansion of the faceplate and the cathode. In one embodiment, the wall is made of alumina dispersed in a zirconia ceramic with ceramic resistivity precisely controlled. In this embodiment, walls are coated with a low secondary emission coating. In one embodiment, walls are made from semi-insulating ceramic materials such as $ZrO_2/Al_2O_3/TiO_2$, $ZrO_2/Al_2O_3/CaO$, or $ZrO_2/Al_3O_3/Y_2O_3$ systems. Using the multicomponent alumina-zirconia ceramic composite allows compositional modification for fine adjustment of the electrical conduction and coefficient of expansion without sacrificing mechanical properties. The coefficient of thermal expansion of these ceramics is known to be relatively close to the coefficient of thermal expansion of soda lime float glass. The coefficient of thermal expansion of alumina-zirconia ceramics can be adjusted by changing the ratio of alumina to zirconia. Furthermore, the electrical conductivity of the alumina-zirconia ceramics can also be controlled by addition of a third component such as, for example, $TiO_2$, $Y_2O_3$, CaO, etc.

In an alternate embodiment, walls are manufactured from ceramic compositions based on mullite ($Al_2O_3/SiO_2$) or corderite ($Mg_3Al_4Si_5O_{18}$). These walls are used with a faceplate and a cathode that are formed using borosilicate float glass. The coefficient of thermal expansion of mullite matches that of borosilicate float glass. Also, dopants(e.g. Ti or Fe) may be added to the mullite system to adjust the resistivity to the desired range. Corderite has a nominal coefficient of thermal expansion of $2.6\times10^{-6}$/° C. However, the coefficient of thermal expansion can be compositionally adjusted to $4.5\times10^{-6}$° C., which matches that of borosilicate float glass. As with mullite, doping the ceramic with Ti, Fe, or some other element can lower the resistivity to the required range.

By using glass manufactured by the float process, cost savings of twenty percent are realized over conventional drawn glass. Also, alumina-zirconia, mullite and corderite ceramics are less expensive to process compared to prior art ceramics since they can be sintered in air at a lower temperature. Also, glass manufactured by the float process has a higher surface quality than conventional drawn glass and may be easier to frit bond. Additionally, alumin-zirconia ceramics have a higher flexture strength as compared with prior art wall materials.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. For example, though the present invention is described with reference to securing walls to a faceplate, the walls could also be attached to the backplate. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method for forming a wall for use in a flat panel display, said method comprising;

providing a ceramic material;

providing a metal oxide material that includes metal oxide particles;

combining said ceramic material and said metal oxide material so as to produce a slurry;

forming said slurry so as to obtain a desired shape;

heating said slurry so as to form a piece of material, said heating step sintering said piece of material and transforming said metal oxide particles into metallic particles; and cutting said piece of material so as to form a wall.

2. The method for forming a wall for use in a flat panel display of claim 1 wherein said step of forming said slurry includes tape casting said slurry.

3. The method for forming a wall for use in a flat panel display of claim 1 wherein said ceramic material comprises alumina.

4. The method for forming a wall for use in a flat panel display of claim 1 wherein said ceramic material comprises titania.

5. The method for forming a wall for use in a flat panel display of claim 1 wherein said metal oxide material comprises molybdenum trioxide.

6. The method for forming a wall for use in a flat panel display of claim 1 wherein said metal oxide material is selected from the group consisting of molybdenum trioxide, niobium pentoxide, tungsten trioxide and nickel oxide.

7. The method for forming a wall for use in a flat panel display of claim 1 wherein said wall has a thermal coefficient of resistivity of less than 3 percent per degree Centigrade.

8. The method for forming a wall for use in a flat panel display of claim 7 wherein said wall has a thermal conductivity greater than 5 Watts per meter-degree Centigrade.

9. The method for forming a wall for use in a flat panel display of claim 1 wherein said wall has a visibility ratio less than 0.6 percent-meter per Watt.

10. The method for forming a wall for use in a flat panel display of claim 1 wherein said wall has a visibility ratio of approximately 0.03 percent-meter per Watt.

11. The method for forming a wall for use in a flat panel display of claim 9 further comprising the step of:

forming a conductive strip extending longitudinally along at least part of said wall.

12. The method for forming a wall for use in a flat panel display of claim 9 further comprising the step of:

disposing a layer of electron emission inhibiting material over said wall.

13. A method for forming a wall for use in a flat panel display, said method comprising;

providing a ceramic material;

providing a metal oxide material that includes metal oxide particles;

combining said ceramic material and said metal oxide material so as to produce a slurry;

forming said slurry so as to obtain a desired shape;

heating said slurry so as to form a piece of material, said heating step sintering said piece of material and transforming said metal oxide particles into metallic particles; and cutting said piece of material so as to form a wall segment.

* * * * *

UNITED STATES PATENT AND TRADEMARK OFFICE

CERTIFICATE OF CORRECTION

PATENT NO. : 6,200,181 B1 
DATED : March 13, 2001
INVENTOR(S) : Kollengode S. Narayanan, George B. Hopple, Theodore S. Fahlen and John P. Klatt It is certified that error appears in the above-identified patent and that said Letters Patent is hereby corrected as shown below:

Title page,
Item [54], Title should read:
-- SPACER MATERIALS AND SPACER ATTACHMENT METHODS FOR THIN CATHODE RAY TUBE --

Signed and Sealed this

Twelfth Day of November, 2002

*Attest:*

*Attesting Officer*

JAMES E. ROGAN
*Director of the United States Patent and Trademark Office*